US007588716B2

(12) United States Patent
Iwata

(10) Patent No.: US 7,588,716 B2
(45) Date of Patent: Sep. 15, 2009

(54) PERIPHERAL LAYER FORMING METHOD FOR MANUFACTURING HONEYCOMB STRUCTURE

(75) Inventor: Satoshi Iwata, Ibi-gun (JP)

(73) Assignee: Ibiden Co., Ltd, Ogaki-shi (JP)

( * ) Notice: Subject to any disclaimer, the term of this patent is extended or adjusted under 35 U.S.C. 154(b) by 0 days.

(21) Appl. No.: 11/963,381

(22) Filed: Dec. 21, 2007

(65) Prior Publication Data

US 2008/0179781 A1 Jul. 31, 2008

(30) Foreign Application Priority Data

Jan. 26, 2007 (WO) ..... PCT/JP2007/051287

(51) Int. Cl.
*B28B 1/00* (2006.01)
*B28B 19/00* (2006.01)

(52) U.S. Cl. ..... 264/630; 427/8; 427/356

(58) Field of Classification Search ..... 264/630, 264/631; 427/9, 356, 358; 118/679; 401/5; 425/163

See application file for complete search history.

(56) References Cited

U.S. PATENT DOCUMENTS 5,090,317 A * 2/1992 Lubke et al. ..... 101/169
5,914,187 A 6/1999 Naruse et al.
6,669,751 B1 12/2003 Ohno et al.
6,849,290 B2 * 2/2005 Makinen et al. ..... 427/8
7,112,233 B2 9/2006 Ohno et al.
7,284,980 B2 10/2007 Saijo et al.
7,309,370 B2 12/2007 Kudo et al.
7,332,014 B2 2/2008 Ono et al.
7,341,614 B2 3/2008 Hayashi et al.
7,348,049 B2 3/2008 Yoshida
7,387,829 B2 6/2008 Ohno et al.
7,393,376 B2 7/2008 Taoka et al.
7,396,586 B2 7/2008 Ohno et al.
7,427,308 B2 9/2008 Taoka et al.
7,427,309 B2 9/2008 Ohno et al.
7,438,967 B2 10/2008 Fujita (Continued)

FOREIGN PATENT DOCUMENTS

DE 19612749 10/1996

(Continued)

*Primary Examiner*—Steven P Griffin
*Assistant Examiner*—Erin Snelting
(74) *Attorney, Agent, or Firm*—Ditthavong Mori & Steiner, P.C.

(57) ABSTRACT

A peripheral layer forming apparatus for coating a pillar-shaped member with a peripheral layer. The apparatus includes supporting members configured to sandwich the member from both sides and support the member so that an axis of the member is maintained in a horizontal orientation. A peripheral layer forming head is provided having a squeegee with a face configured to be oriented parallel to the axis. The apparatus is configured to provide the face at a predetermined angle with respect to a virtual face, where the virtual face is defined as a plane that is parallel to the axis of the member and that is tangential to a contact point on a peripheral face of the member where the squeegee is configured to contact the member. The apparatus is configured to maintain the predetermined angle as a peripheral layer is formed on the peripheral face of the member by a movement of at least one of the squeegee and the member.

7 Claims, 14 Drawing Sheets

U.S. PATENT DOCUMENTS

| | | | |
|---|---|---|---|
| 7,449,427 | B2 | 11/2008 | Ohno et al. |
| 7,462,216 | B2 | 12/2008 | Kunieda et al. |
| 7,473,465 | B2 | 1/2009 | Ohno et al. |
| 2003/0003234 | A1 | 1/2003 | Park et al. |
| 2003/0064152 | A1 | 4/2003 | Takimoto et al. |
| 2004/0161596 | A1 | 8/2004 | Taoka et al. |
| 2005/0082705 | A1* | 4/2005 | Adriaansen et al. ..... 264/40.1 |
| 2005/0109023 | A1 | 5/2005 | Kudo et al. |
| 2005/0153099 | A1 | 7/2005 | Yamada |
| 2005/0169819 | A1 | 8/2005 | Shibata |
| 2005/0175514 | A1 | 8/2005 | Ohno |
| 2005/0180898 | A1 | 8/2005 | Yamada |
| 2005/0247038 | A1 | 11/2005 | Takahashi |
| 2005/0249877 | A1 | 11/2005 | Noro et al. |
| 2005/0255288 | A1* | 11/2005 | Noguchi et al. ..... 428/116 |
| 2005/0272602 | A1 | 12/2005 | Ninomiya |
| 2006/0029898 | A1 | 2/2006 | Saijo et al. |
| 2006/0043652 | A1 | 3/2006 | Saijo et al. |
| 2006/0051556 | A1 | 3/2006 | Ohno et al. |
| 2006/0073970 | A1 | 4/2006 | Yamada |
| 2006/0108347 | A1 | 5/2006 | Koyama et al. |
| 2006/0118546 | A1 | 6/2006 | Saijo |
| 2006/0166820 | A1 | 7/2006 | Ogyu et al. |
| 2006/0210765 | A1 | 9/2006 | Ohno et al. |
| 2006/0216466 | A1 | 9/2006 | Yoshida |
| 2006/0216467 | A1 | 9/2006 | Yoshida |
| 2006/0222812 | A1 | 10/2006 | Koyama et al. |
| 2006/0225390 | A1 | 10/2006 | Yoshida |
| 2006/0230732 | A1 | 10/2006 | Kunieda |
| 2006/0245465 | A1 | 11/2006 | Saijo et al. |
| 2006/0269722 | A1 | 11/2006 | Yamada |
| 2007/0020155 | A1 | 1/2007 | Ohno et al. |
| 2007/0028575 | A1 | 2/2007 | Ohno et al. |
| 2007/0044444 | A1 | 3/2007 | Oshimi |
| 2007/0068128 | A1 | 3/2007 | Oshimi et al. |
| 2007/0085233 | A1 | 4/2007 | Yamada |
| 2007/0116908 | A1 | 5/2007 | Ohno et al. |
| 2007/0126160 | A1 | 6/2007 | Takahashi |
| 2007/0128405 | A1 | 6/2007 | Sakaguchi et al. |
| 2007/0130897 | A1 | 6/2007 | Sakaguchi et al. |
| 2007/0144561 | A1 | 6/2007 | Saijo et al. |
| 2007/0148403 | A1 | 6/2007 | Yamamura et al. |
| 2007/0152382 | A1 | 7/2007 | Yamada et al. |
| 2007/0169453 | A1 | 7/2007 | Hayakawa |
| 2007/0175060 | A1 | 8/2007 | Idei et al. |
| 2007/0178275 | A1 | 8/2007 | Takahashi |
| 2007/0187651 | A1 | 8/2007 | Naruse et al. |
| 2007/0190350 | A1 | 8/2007 | Ohno et al. |
| 2007/0196620 | A1 | 8/2007 | Ohno et al. |
| 2007/0199205 | A1 | 8/2007 | Hoshino et al. |
| 2007/0199643 | A1 | 8/2007 | Kawai et al. |
| 2007/0202455 | A1 | 8/2007 | Saijo et al. |
| 2007/0204580 | A1 | 9/2007 | Kunieda |
| 2007/0212517 | A1 | 9/2007 | Ohno et al. |
| 2007/0235895 | A1 | 10/2007 | Yamamura et al. |
| 2007/0243283 | A1 | 10/2007 | Yamamura et al. |
| 2007/0262497 | A1 | 11/2007 | Yamamura et al. |
| 2007/0262498 | A1 | 11/2007 | Saijo et al. |
| 2007/0277655 | A1 | 12/2007 | Kawai et al. |
| 2007/0293392 | A1 | 12/2007 | Ohno et al. |
| 2008/0006971 | A1 | 1/2008 | Kawai et al. |
| 2008/0120950 | A1 | 5/2008 | Ohno et al. |
| 2008/0136062 | A1 | 6/2008 | Kasai et al. |
| 2008/0138567 | A1 | 6/2008 | Ninomiya et al. |
| 2008/0174039 | A1 | 7/2008 | Saijo et al. |
| 2008/0190081 | A1 | 8/2008 | Oshimi |
| 2008/0190083 | A1 | 8/2008 | Oshimi |
| 2008/0213485 | A1 | 9/2008 | Shibata |
| 2008/0236115 | A1 | 10/2008 | Sakashita |
| 2008/0236122 | A1 | 10/2008 | Ito |
| 2008/0236724 | A1 | 10/2008 | Higuchi |
| 2008/0241015 | A1 | 10/2008 | Kudo et al. |
| 2008/0241444 | A1 | 10/2008 | Oshimi |
| 2008/0241466 | A1 | 10/2008 | Saito et al. |
| 2008/0284067 | A1 | 11/2008 | Naruse et al. |
| 2008/0305259 | A1 | 12/2008 | Saijo |
| 2008/0318001 | A1 | 12/2008 | Sakakibara |
| 2009/0004431 | A1 | 1/2009 | Ninomiya |

FOREIGN PATENT DOCUMENTS

| | | |
|---|---|---|
| DE | 19731947 | 1/1999 |
| EP | 1065004 | 1/2001 |
| EP | 1262244 | 12/2002 |
| EP | 1533032 | 5/2005 |
| JP | 2002-219393 | 8/2002 |
| JP | 2003-033709 | 2/2003 |
| JP | 2004-141708 | 5/2004 |
| JP | 2004-202452 | 7/2004 |
| WO | WO 00/78520 | 12/2000 |

* cited by examiner

α − α line cross-sectional view

PERIPHERAL LAYER FORMING METHOD FOR MANUFACTURING HONEYCOMB STRUCTURE

CROSS-REFERENCE TO RELATED APPLICATIONS

The present application claims priority under 35 U.S.C. §119 to PCT Application No. PCT/JP2007/051287, filed Jan. 26, 2007. The contents of this PCT application are incorporated herein by reference in their entirety.

BACKGROUND OF THE INVENTION

1. Field of the Invention

The present invention relates to a peripheral layer forming apparatus and a method for manufacturing a honeycomb structure.

2. Discussion of the Background

In recent years, particulates such as soot contained in exhaust gases discharged from internal combustion engines of vehicles, such as buses and trucks, construction machines and the like, have become a serious problem as such contaminants are harmful to the environment and the human body. For this reason, various particulate filters, which use a honeycomb structure made of porous ceramics to collect particulates in exhaust gases and purify the exhaust gases, have been proposed. Moreover, honeycomb structures, which support a catalyst in contact with exhaust gases to convert nitride oxides and the like in exhaust gases, have been known.

A peripheral layer is sometimes formed on a periphery of such a honeycomb structure to prevent leakage of exhaust gases and also to improve the mechanical strength of the honeycomb structure.

Japanese Unexamined Patent Application Publication 2004-141708 A describes a peripheral layer forming apparatus used for forming such a peripheral layer. The contents of Japanese Unexamined Patent Application Publication 2004-141708 A are incorporated herein by reference in their entirety.

SUMMARY OF THE INVENTION

The present invention advantageously provides a peripheral layer forming apparatus for coating a pillar-shaped member with a peripheral layer, where the apparatus includes supporting members configured to sandwich the pillar-shaped member from both sides of an axis direction of the pillar-shaped member. The supporting members are configured to support the pillar-shaped member so that an axis of the pillar-shaped member is maintained in a horizontal orientation. The apparatus further includes a peripheral layer forming head having a squeegee with a face configured to be oriented parallel to the axis. The peripheral layer forming apparatus is configured to provide the face at a predetermined angle with respect to a virtual face, where the virtual face is defined as a plane that is parallel to the axis of the pillar-shaped member and that is tangential to a contact point on a peripheral face of the pillar-shaped member where the squeegee is configured to contact the pillar-shaped member. And, the peripheral layer forming apparatus is configured to maintain the predetermined angle as a peripheral layer is formed on the peripheral face of the pillar-shaped member by a movement of at least one of the squeegee and the pillar-shaped member.

The present invention further advantageously provides a method for manufacturing a honeycomb structure that includes molding a ceramic material to manufacture a pillar-shaped honeycomb molded body having a plurality of cells longitudinally disposed parallel to one another with a cell wall therebetween, firing the honeycomb molded body to manufacture a honeycomb fired body, and forming a peripheral layer on a peripheral face of a pillar-shaped honeycomb block including one or a plurality of the honeycomb fired bodies by use of a peripheral layer forming apparatus. The peripheral layer forming apparatus includes supporting members, a peripheral layer forming head having a squeegee with a face, and a material supplying unit that supplies the peripheral layer forming material to the peripheral face. The forming of the peripheral layer includes allowing the supporting members to sandwich the honeycomb block from both sides of an axis direction of the honeycomb block to support the honeycomb block so that an axis of the honeycomb block is maintained in a horizontal direction, allowing the material supplying unit to supply a peripheral layer forming material to the peripheral face, and allowing at least one of the squeegee and the honeycomb block to move so as to maintain a predetermined angle between the face of the squeegee and a virtual face, where the virtual face is defined as a plane that is parallel to the axis of the pillar-shaped member and that is tangential to a contact point on a peripheral face of the pillar-shaped member where the squeegee is configured to contact the pillar-shaped member.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings.

DETAILED DESCRIPTION OF EMBODIMENTS OF THE INVENTION

Figure 1:
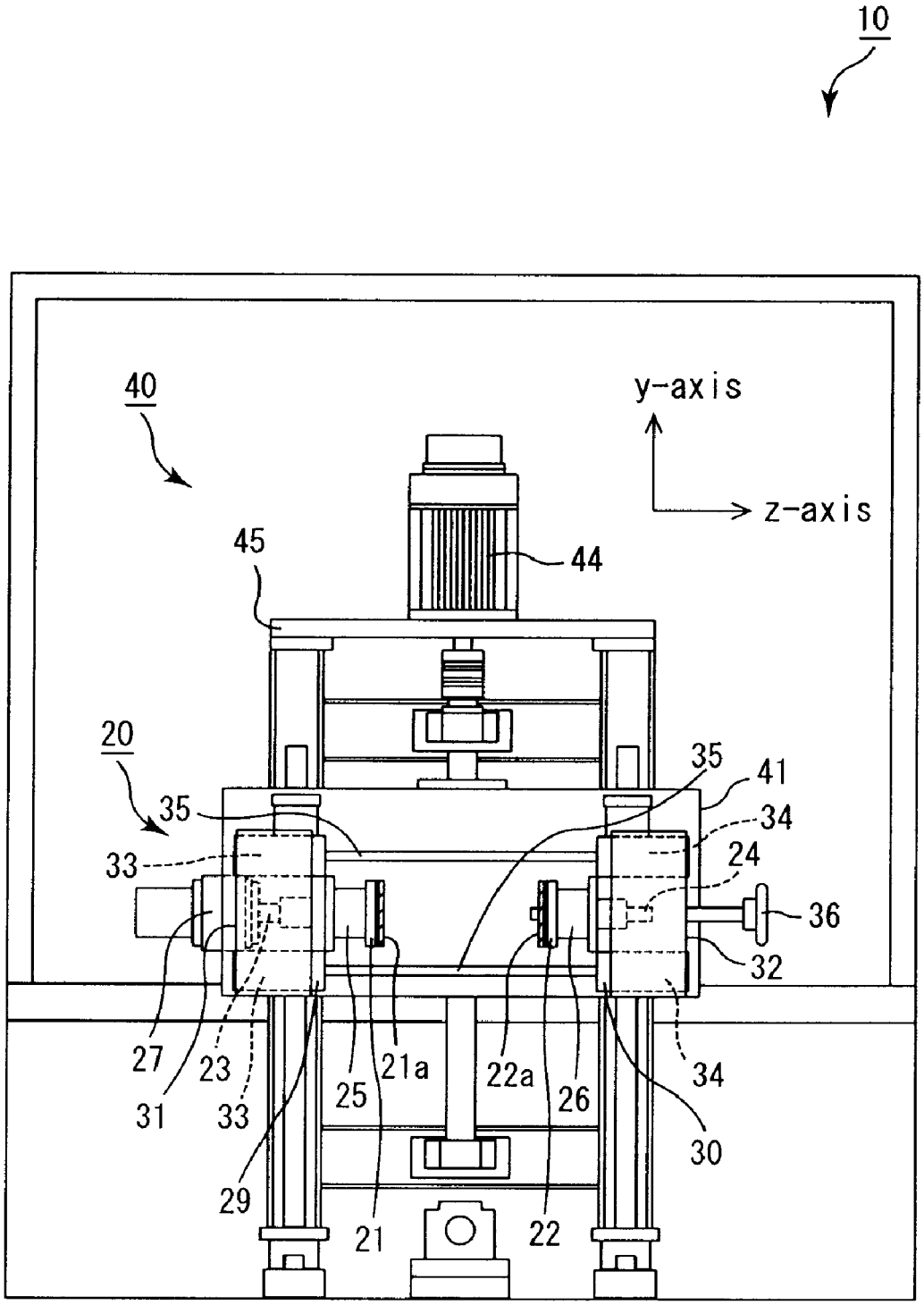
FIG. 1 is a front view of a peripheral layer forming apparatus according to a first embodiment of the present invention.

The embodiments will now be described with reference to the accompanying drawings, wherein like reference numerals designate corresponding or identical elements throughout the various drawings.

A peripheral layer forming apparatus of an embodiment according to a first aspect of the present invention includes supporting members sandwiching a pillar-shaped member to be coated with a peripheral layer from both sides of an axis direction of the pillar-shaped member to be coated with a peripheral layer to support the pillar-shaped member to be coated with a peripheral layer so that an axis of the member to be coated with a peripheral layer is maintained in a horizontal direction, and a peripheral layer forming head, having a squeegee with a face parallel to the axis direction, where a predetermined angle is formed by the face of the squeegee and a virtual face including a line parallel to the axis direction on a peripheral face of the member to be coated with a peripheral layer and simultaneously being in contact with the peripheral face, and a peripheral layer is formed on the peripheral face of the member to be coated with a peripheral layer by a movement of at least one of the squeegee and the member to be coated with a peripheral layer so as to maintain the predetermined angle.

According to the embodiment of the first aspect of the present invention, since the member to be coated with a peripheral layer is supported horizontally, it becomes easy to prevent the peripheral layer formed on the member to be coated with a peripheral layer from being deviated by gravity, and consequently to improve the uniformity of the peripheral layer in comparison with that of Japanese Unexamined Patent Application Publication 2004-141708 A.

Moreover, since the member to be coated with a peripheral layer is supported horizontally, it becomes easy to prevent the peripheral layer forming material from dropping from the member to be coated with a peripheral layer by gravity. With this arrangement, for example, it becomes easy to prevent the dropped peripheral layer forming material from adhering to the rotating shaft and the like of the peripheral layer forming apparatus, thereby making it possible to prevent problems such as failure in the rotation of the rotating shaft.

Since the dropping of the peripheral layer forming material from the member to be coated with a peripheral layer is prevented, the necessity of frequently cleaning the dropped material can be eliminated, so that the number of maintenance is reduced and the running cost may also be reduced.

In an embodiment according to a second aspect of the present invention, a peripheral layer forming material supplying unit that supplies a peripheral layer forming material to the peripheral face of the member to be coated with a peripheral layer may be disposed to continuously form the peripheral layer on the member to be coated with a peripheral layer.

In an embodiment according to a third aspect of the present invention, the peripheral layer forming material supplying unit supplies the peripheral layer forming material to a vicinity of the peripheral face in an advancing direction of the peripheral layer forming head relative to the peripheral face of the member to be coated with a peripheral layer.

According to the embodiment of the third aspect of the present invention, the material supplied to the peripheral face by the peripheral layer forming material supplying unit is immediately contacted with the peripheral layer forming head (squeegee). For this reason, it becomes easy to further reduce the dropping of the peripheral layer forming material from the peripheral face.

In particular, immediately after the start of formation of the peripheral layer, a hard peripheral portion of the member to be coated with a peripheral layer on which a peripheral layer has not been formed is contacted with the peripheral layer forming head (squeegee) to sometimes cause damage of the peripheral layer forming head (squeegee). However, in the embodiment according to the third aspect of the present invention, since the material supplied to the peripheral face by the peripheral layer forming material supplying unit is immediately contacted with the peripheral layer forming head, it becomes possible to solve the problem.

In an embodiment according to a fourth aspect of the present invention, the peripheral layer forming head and the peripheral layer forming material supplying unit are integrally formed. According to the embodiment of the fourth aspect of the present invention, the peripheral layer forming head and the peripheral layer forming material supplying unit can be disposed in the closest state. With this arrangement, the effect of preventing the material from dropping and the effect of preventing the peripheral layer forming head from being damaged, described in the embodiment of the third aspect of the present invention, can be exerted more efficiently.

In the case where the peripheral layer forming head and the peripheral layer forming material supplying unit are separately disposed, the two members may be contacted with each other. However in the case where the peripheral layer forming head and the peripheral layer forming material supplying unit are integrally disposed like the embodiment of the fourth aspect of the present invention, the contact of the two members may easily be prevented.

Moreover, as an embodiment according to a fifth aspect of the present invention, in the case where the peripheral layer forming material supplying unit is disposed above the member to be coated with a peripheral layer in a supported state, since the peripheral face is located in a dropping direction of the peripheral layer forming material, it is easy to further reduce the dropping of the peripheral layer forming material more effectively.

In an embodiment according to a sixth aspect of the present invention, a first driving mechanism is provided that is capable of controlling at least one of a movement of the supporting member in the axis direction, a movement of the supporting member in an axis radial direction of the axis, and a rotational motion of the supporting member in an axis circumferential direction of the axis, where the axis circumferential direction corresponds to a rotational direction.

Moreover, in an embodiment according to a seventh aspect of the present invention, a second driving mechanism is provided that is capable of controlling at least one of a movement of the peripheral layer forming head in the axis direction, a movement of the peripheral layer forming head in the axis radial direction of the axis, and a rotational motion of the peripheral layer forming head in the axis circumferential direction of the axis, where the axis circumferential direction corresponds to a rotational direction.

According to the embodiments of the sixth and seventh aspects of the present invention, the peripheral layer can be practically formed on the peripheral face of the member to be coated with a peripheral layer.

In an embodiment according to an eighth aspect of the present invention, an electronic control device that controls operations of at least one of the first driving mechanism and the second driving mechanism by outputting an electrical signal is disposed, and at least one of the first driving mechanism and the second driving mechanism is operated based on an input of the electrical signal.

In the peripheral layer forming apparatus described in Japanese Unexamined Patent Application Publication 2004-141708 A, the operations of the squeegee are controlled by using cams. For this reason, it is not possible to form a peripheral layer on each of members to be coated with a peripheral layer having different peripheral shapes without changing cams through complicated processes. However, in the embodiment according to the eighth aspect of the present invention, since the electronic control device controls the operations of at least one of the first driving mechanism and second driving mechanism, it is possible to form a peripheral layer on each of members to be coated with a peripheral layer having various kinds of peripheral shapes by using a peripheral layer forming apparatus having the same structure.

In an embodiment according to a ninth aspect of the present invention where the predetermined angle is about 30 to about 60°, a more uniform peripheral layer may easily be formed. Since the peripheral layer is formed uniformly, it is easy to prevent leakage of exhaust gases from the resulting honeycomb structure after the formation of the peripheral layer, and also to prevent chipping and the like in the cell walls; thus, a superior appearance may easily be obtained.

In an embodiment according to a tenth aspect of the present invention, in the case where a shape of a cross section perpendicular to the axis direction of the member to be coated with a peripheral layer is a non-circular shape such as an elliptical shape, a racetrack shape, an almost triangular shape, a recessed shape, a polygonal shape, or an almost polygonal shape, the peripheral layer forming apparatus of the embodiments according to the first to ninth aspects of the present invention can exert those effects more efficiently.

In particular in the embodiment according to the eighth aspect of the present invention where the electronic control device controls at least one of the first driving mechanism that operates the supporting members and the second driving mechanism that operates the peripheral layer forming head, even if, for example, the peripheral shape has a polygonal shape having points of reverse curvature, the predetermined angle of the member to be coated with a peripheral layer to the peripheral shape may easily be maintained at a constant value.

Moreover, in the case of a shape in which the curvature of the peripheral shape varies, such as an elliptical shape and a racetrack shape, the predetermined angle can be changed in response to the corresponding curvature. With this arrangement, even in the case where the angle that is capable of forming a peripheral layer with a predetermined thickness differs between a portion having a large curvature and a portion having a small curvature, it is possible to form a more uniform peripheral layer.

In an embodiment according to an eleventh aspect of the present invention, a method for manufacturing a honeycomb structure includes molding a ceramic material to manufacture a pillar-shaped honeycomb molded body having a large number of cells longitudinally disposed parallel to one another with a cell wall therebetween, firing the honeycomb molded body to manufacture a honeycomb fired body, and forming a peripheral layer on a peripheral face of a pillar-shaped honeycomb block comprising one or a plurality of the honeycomb fired bodies by use of a peripheral layer forming apparatus. The peripheral layer forming apparatus includes supporting members, a peripheral layer forming head, having the squeegee with the face, and a peripheral layer forming material supplying unit that supplies the peripheral layer forming material to the peripheral face. The forming of the peripheral layer includes allowing the supporting members to sandwich the honeycomb block from both sides of an axis direction of the honeycomb block to support the honeycomb block so that an axis of the honeycomb block is maintained in a horizontal direction, allowing a peripheral layer forming material supplying unit to supply a peripheral layer forming material to the peripheral face, and allowing at least one of the squeegee and the honeycomb block to move so as to maintain a predetermined angle, formed by the face of the squeegee and a virtual face including a line parallel to the axis direction on the peripheral face and simultaneously being in contact with the peripheral face, so that a peripheral layer is formed on the peripheral face.

In the manufacturing method of the embodiment according to the eleventh aspect of the present invention, since the honeycomb block is supported horizontally, it becomes easy to prevent the peripheral layer forming material from dropping from a honeycomb block by gravity. With this arrangement, for example, it is easy to prevent the dropped peripheral layer forming material from adhering to the rotating shaft and the like of the peripheral layer forming apparatus, thereby making it possible to prevent problems such as failure in the rotation of the rotating shaft.

Since the dropping of the peripheral layer forming material from the honeycomb block is prevented, the necessity of frequently cleaning the dropped material can be eliminated, so that the number of maintenance may be reduced and the running cost may also be reduced.

Moreover, since the honeycomb block is supported horizontally, it becomes possible to prevent the peripheral layer formed on the honeycomb block from dropping by gravity and being deviated, and consequently to improve the uniformity of the peripheral layer in comparison with that of Japanese Unexamined Patent Application Publication 2004-141708 A.

Moreover, in an embodiment according to a twelfth aspect of the present invention, the peripheral layer forming apparatus further includes at least one of a first driving mechanism being capable of controlling at least one of a movement of the supporting member in the axis direction, a movement of the supporting member in an axis radial direction of the axis and a rotational motion of the supporting member in an axis circumferential direction of the axis, the axis circumferential direction corresponding to a rotational direction, and a second driving mechanism being capable of controlling at least one of a movement of the peripheral layer forming head in the axis direction, a movement of the peripheral layer forming head in the axis radial direction of the axis and a rotational motion of the peripheral layer forming head in the axis circumferential direction of the axis, the axis circumferential direction corresponding to a rotational direction; and an electronic control device that controls at least one of the first driving mechanism and the second driving mechanism by outputting an electrical signal, and the forming of the peripheral layer further includes allowing the electronic control device to find an ideal locus used for moving the squeegee relative to a periphery of the honeycomb block so as to maintain the predetermined angle, allowing the electronic control device to find an actual movement locus of the squeegee upon relatively moving the squeegee, and allowing the electronic control device to control operation of at least one of the first driving mechanism and the second driving mechanism so as to make the ideal locus and the actual movement locus coincident with each other.

According to the embodiment of the twelfth aspect of the present invention, at least one of the first driving mechanism and the second driving mechanism is controlled based on the ideal locus obtained by the electronic control device. Moreover, the electronic control device monitors the actual movement locus of the squeegee, and controls so that it is made coincident with the ideal locus. As a result, it is easy to maintain a predetermined angle between the face of the squeegee and the virtual face made in contact with the peripheral face. With this arrangement, it is possible to form a peripheral layer more uniformly.

In the peripheral layer forming apparatus described in Japanese Unexamined Patent Application Publication 2004-141708 A, the operations of the squeegee are controlled by using cams. For this reason, it is not possible to form a peripheral layer on each of honeycomb blocks having different peripheral shapes without changing cams through complicated processes. However, in the present invention, since the electronic control device controls the operation of at least one of the first driving mechanism and second driving mechanism, it is possible to form a peripheral layer on each of honeycomb blocks having various kinds of peripheral shapes by using a peripheral layer forming apparatus having the same structure.

Moreover, in an embodiment according to a thirteenth aspect of the present invention where the predetermined angle is about 30 to about 60°, a more uniform peripheral layer may easily be formed.

In an embodiment according to a fourteenth aspect of the present invention where a shape of a cross section perpendicular to the axis direction of the honeycomb block is an elliptical shape, a racetrack shape, an almost triangular shape, a recessed shape, a polygonal shape, or an almost polygonal shape, the manufacturing method of the embodiments according to the eleventh to thirteenth aspects of the present invention can exert those effects more efficiently.

In the case where the electronic control device controls at least one of the first driving mechanism that operates the supporting members and the second driving mechanism that operates the peripheral layer forming head, even if, for example, the peripheral shape has a polygonal shape having points of reverse curvature, the predetermined angle of the member to be coated with a peripheral layer to the peripheral shape can be maintained at a constant value.

Moreover, in the case of a shape in which the curvature of the peripheral shape varies, such as an elliptical shape and a racetrack shape, the predetermined angle can be changed in response to the corresponding curvature. With this arrangement, even in the case where the angle that is capable of forming a peripheral layer with a predetermined thickness differs between a portion having a large curvature and a portion having a small curvature, it is possible to form a more uniform peripheral layer. In other words, honeycomb blocks having various shapes can be suitably manufactured, and the honeycomb blocks thus manufactured may be easily changed in specifications as well as in designing.

In the peripheral layer forming apparatus of Japanese Unexamined Patent Application Publication 2004-141708 A, however, since a pillar-shaped honeycomb structure is supported with an axis (longitudinal direction) being vertical, the peripheral layer, which was uniform immediately after the formation of the peripheral layer, becomes nonuniform due to deviations in a paste-state peripheral layer forming material by gravity.

Moreover, another problem is that the paste-state peripheral layer forming material tends to easily drop. For example, in the case where the dropped peripheral layer forming material adheres to a rotating shaft of the peripheral layer forming apparatus, a problem such as failure in rotation might be raised. In order to prevent such a problem, the dropped peripheral layer forming material needs to be cleaned frequently.

An embodiment of the present invention makes it possible to manufacture a member to be coated with a peripheral layer on which a peripheral layer is more uniform, and to reduce dropping of the peripheral layer forming material from the member to be coated with a peripheral layer.

First Embodiment

Referring to the figures, the following description will discuss a first embodiment of the present invention.

Figure 2:
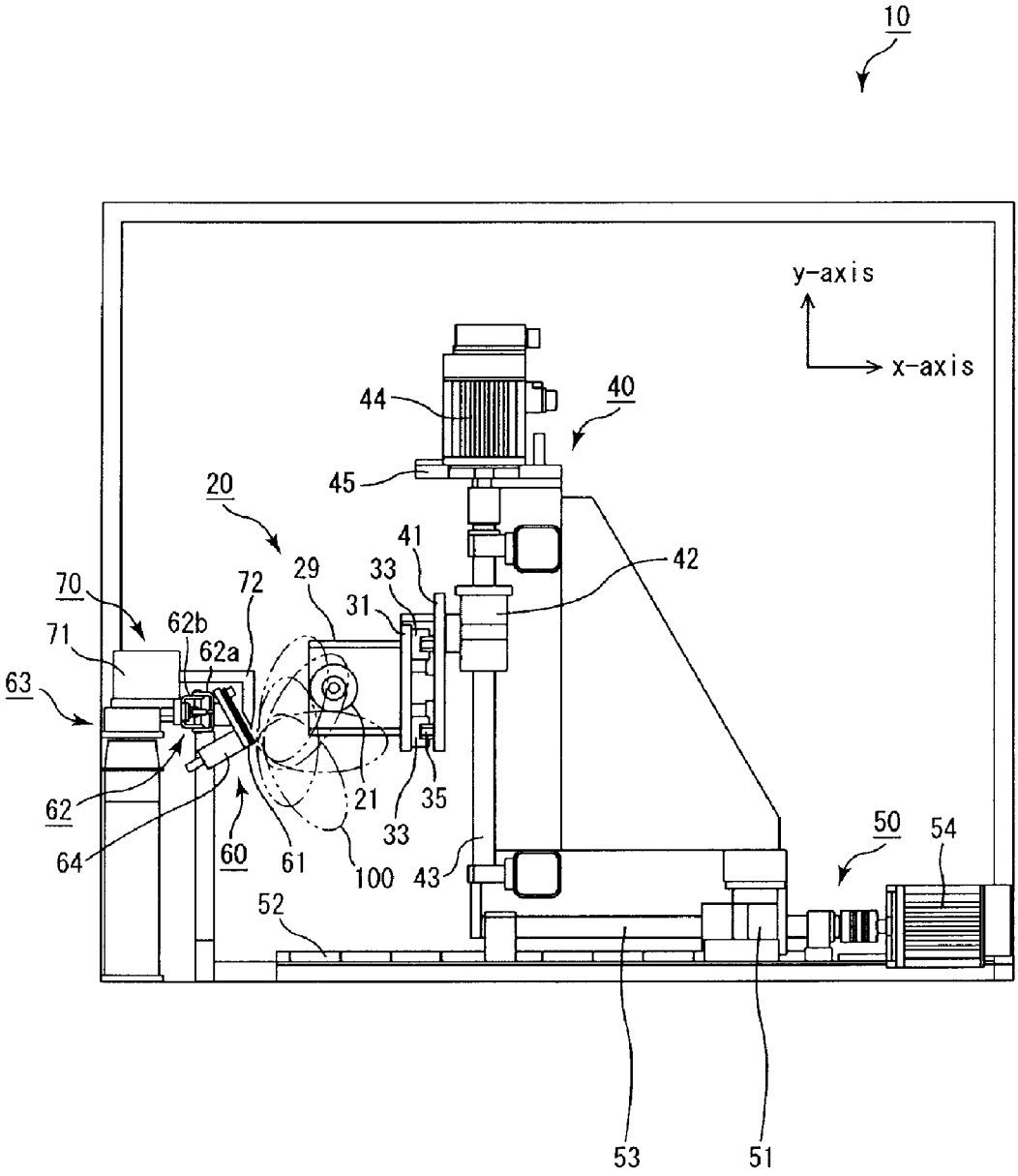
FIG. 2 is a side view of the peripheral layer forming apparatus shown in FIG. 1.

FIG. 1 is a front view that shows a peripheral layer forming apparatus according to the first embodiment of the present invention, and FIG. 2 is a side face half-cross-sectional view that shows the peripheral layer forming apparatus shown in FIG. 1.

Here, for ease of understanding of the structure, a peripheral layer forming head and the like are omitted in FIG. 1. Moreover, a supporting member and the like, disposed on the right side of the apparatus shown in FIG. 1, are omitted in FIG. 2.

A peripheral layer forming apparatus 10 is provided with supporting members 21 and 22, motion control mechanisms (first driving mechanism) 20, 40 and 50, a peripheral layer forming head 60 and a peripheral layer forming material supplying unit 70.

First, a support and rotation mechanism 20 will be described. The support and rotation mechanism 20, which controls a support for a honeycomb block (a member to be coated with a peripheral member) 100 and a rotation of an axis O in an axis circumferential direction, is configured by supporting members 21 and 22, shafts 23 and 24, shaft receivers 25 and 26, a θ-axis servo 27 and the like.

Each of the supporting members 21 and 22 has a disc shape with such a size that an outer shape thereof does not stick out of the cross section of the honeycomb block 100. Supporting faces 21*a* and 22*a* (contact faces between the supporting members 21 and 22 and the honeycomb block 100) are disposed face to face parallel to each other.

Figure 7:
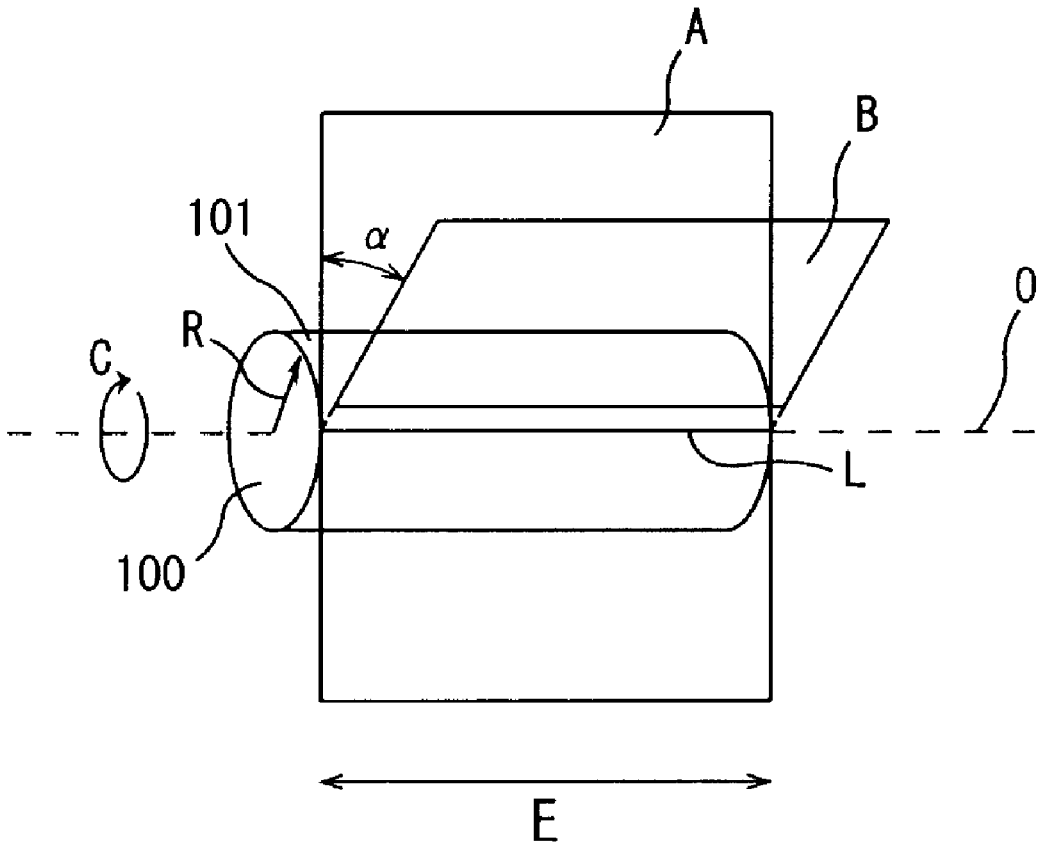
FIG. 7 is a schematic view that shows a relationship between a peripheral face of a honeycomb block and a squeegee.

The supporting members 21 and 22 support a pillar-shaped honeycomb block 100 having an elliptical cross section from two sides in an axis direction (the direction shown by an arrow E in FIG. 7) of its axis (center axis of an ellipse indicated by a broken line O in FIG. 7). This honeycomb block 100 will be described later. Since the supporting faces 21*a* and 22*a* are disposed in the vertical direction, the honeycomb block 100 is supported with its axis maintained in the horizontal direction. The honeycomb block 100, which is shown in FIG. 2, is omitted from FIG. 1 for simplicity of drawing.

One of the supporting members 21, positioned on the left side in FIG. 1, is secured to one end of the shaft 23 near the center of the face on the side opposite to the supporting face 21*a*. The shaft 23 is rotatably supported by the shaft receiver 25. Moreover, on the side opposite to the supporting member 21 of the shaft 23, the θ-axis servo 27 provided with a stepping motor is disposed. That is, since the supporting member 21 and the θ-axis servo 27 are connected by a power path of the θ-axis servo 27, the rotational motion of the supporting member 21 can be controlled by the operation of the θ-axis servo 27.

In contrast, the other supporting member 22 positioned on the right side in FIG. 1 is secured to the shaft 24 and supported by the shaft receiver 26 in the same manner as in the supporting member 21. Different from the supporting member 21, the other supporting member 22 is not connected to the servo serving as a power source, with the result that it is not allowed to rotate independently. In other words, the other supporting member 22 is allowed to follow the rotation of the supporting member 21 only in the state of supporting the honeycomb block 100. Here, the other supporting member 22 may be rotated in synchronism with the supporting member 21, by being connected to the power source such as a servo.

The shaft receiver 25 is secured to a fixing plate 29 disposed parallel to the supporting face 21*a*. This fixing plate 29 is secured to a supporting plate 31 disposed perpendicularly to the supporting face 21*a*. The supporting plates 31 and 32 are slidably disposed on a base plate 41 through supporting sliders 33 and 34 and supporting rails 35 with the rear face.

With this structure, the movement in the z-axis direction (see FIG. 1) of the supporting members 21 and 22 that are integral with the supporting plates 31 and 32 can be carried out by the movement of the supporting plates 31 and 32. Therefore, the distance between the supporting face 21*a* and the supporting face 22*a*, that is, the supporting operation of the honeycomb block 100, can be controlled by the movement of the supporting plates 31 and 32 in the z-axis direction.

Here, the fixing plates 29 and 30 are connected to an air cylinder 36 disposed on the base plate 41. Reciprocating motion in the z-axis direction of the air cylinder 36 allows the fixing plates 29 and 30 to slide in the z-axis direction relative to the base plate 41. The sliding movement of the fixing plates 29 and 30 varies the distance between the supporting face 21*a* and the supporting face 22*a*. That is, the air cylinder 36 allows the supporting face 21*a* and the supporting face 22*a* to come closer to each other and also to move away from each other.

The following description will discuss a lifting and lowering control mechanism 40. The lifting and lowering control mechanism 40, which controls a movement of the supporting members 21 and 22 in the y-axis direction, includes the base plate 41, a vertical slider 42, a ball screw 43, a y-axis servo 44 and the like.

The base plate 41 is attached to the vertical slider 42. The cylindrical vertical slider 42 is internally screwed together with the ball screw 43 extending in the vertical direction. The ball screw 43 is coupled to a stepping motor of the y-axis servo 44. They-axis servo 44 is secured to a top plate 45.

In the lifting and lowering control mechanism 40 having this structure, the ball screw 43 is rotated upon operation of the y-axis servo 44, and in accordance with this rotation, the vertical slider 42 is lifted or lowered in the y-axis direction. Therefore, the lifting and lowering motion in the vertical direction of the base plate 41 integral with the vertical slider 42 are freely controlled by the rotational motion of the stepping motor attached to the y-axis servo 44.

Next, the following description will discuss a forward and backward motion control mechanism 50. The forward and backward motion control mechanism 50, which controls a movement of the lifting and lowering control mechanism 40 in the forward and backward (x-axis) direction, by extension the movement of a support and rotation mechanism 20, includes a horizontal slider 51, a horizontal rail 52, a ball screw 53, an x-axis servo 54 and the like.

The lifting and lowering control mechanism 40 is coupled to the horizontal slider 51 at its lower portion. The horizontal slider 51 is attached slidably onto the horizontal rail 52. The horizontal slider 51 is screwed together with the ball screw 53 extending in the horizontal direction (the x-axis direction). The ball screw 53 is coupled to a stepping motor of the x-axis servo 54.

In the forward and backward motion control mechanism 50 having this structure, the rotation of the stepping motor disposed in the x-axis servo 54 allows the ball screw 53 to rotate, and the rotation of the ball screw 53 allows the horizontal slider 51 screwed together with the ball screw 53 to carry out forward and backward motion in the x-axis direction along the horizontal rail 52. In other words, the x-axis servo 54 can freely control the forward and backward motion of the horizontal slider 51.

The support and rotation mechanism 20, the lifting and lowering control mechanism 40 and the forward and backward motion control mechanism 50, as described above, constitute a first driving mechanism.

That is, the rotational motion in the rotational direction (the direction shown by an arrow C in FIG. 7) corresponding to the axis circumferential direction of the axis O of the honeycomb block 100 in its supported state is controlled by the support and rotation mechanism 20. Moreover, the lifting and lowering motion in the y-axis direction are controlled by the lifting and lowering control mechanism 40, and the forward and backward motion in the x-axis direction are controlled by the forward and backward motion control mechanism 50.

In other words, the support and rotation mechanism 20, the lifting and lowering control mechanism 40 and the forward and backward motion control mechanism 50 cooperatively control freely the movement of the supporting members 21 and 22 that support the honeycomb block 100 in the axis radial direction (the direction shown by an arrow R in FIG. 7) of the axis O on the x-z plane as well as rotational motion thereof in the rotational direction corresponding to the axis circumferential direction of the axis O.

Next, the following description will discuss a peripheral layer forming head 60. This peripheral layer forming head 60 is provided with a squeegee 61 used for forming a peripheral layer through relative motion with the honeycomb block 100.

The squeegee 61 has an almost rectangular shape in plan view with a predetermined thickness. This squeegee 61 is secured to the upper portion of a head base 63 by interposing a joint 62. The joint 62 has a structure in which vicinities of the two ends of a coupling member 62*b*, which is slightly small and has an almost semicircular shape, are internally in contact with vicinities of the two ends of a coupling member 62*a*, which is slightly large and has an almost semicircular shape, so that they are rotatably secured by stopping pins penetrating the upper vicinities of the two ends and the lower vicinities of the two ends. In the peripheral layer forming head 60, the face on the opposite side (hereinafter, referred to also as a back face of a squeegee) to the face on which the squeegee 61 and the honeycomb block 100 is made close to each other (hereinafter, referred to also as a squeegee vicinal face) and the coupling member 62*a* are continuously coupled to one after another, and in contrast, the coupling member 62*b* and the upper portion of the head base 63 are coupled to each other. Moreover, since the stopping pins are disposed to be positioned in the y-axis direction, the joint 62 serves as a swing mechanism so that the squeegee 61 can be swung laterally to the head base 63 centered on this joint 62.

Moreover, an angle adjusting member 64, which can change the angle that is made by the squeegee 61 and the horizontal face, is attached to the gap between the back face of the squeegee 61 and the head base 63. By changing the length of the angle adjusting member 64, the angle between the vicinal face of the squeegee 61 and the horizontal face can be appropriately changed.

The following description will discuss a paste supplying device 70 that serves as a peripheral layer forming material supplying unit. The paste supplying device 70 is configured by a paste storage unit 71 storing sealing material paste (peripheral layer forming material) and a supplying nozzle 72.

The paste storage unit 71 is disposed on the upper portion of the head base 63, and the sealing material paste is continuously or intermittently supplied to the paste storage unit 71 externally, and stored therein. The supplying nozzle 72 is connected to the side face of the paste storage unit 71, and the supplying nozzle 72 is extended from the side face of the paste storage unit 71 to a vicinal area between the squeegee 61 and the honeycomb block 100. The supplying port of the supplying nozzle 72 is disposed above the honeycomb block 100.

The supply amount of the sealing material paste from the paste supplying device 70 can be increased or reduced automatically or manually so that the supply amount can be increased or reduced depending on the outer shape of the honeycomb block 100 and the changes in the operational conditions upon forming a peripheral layer.

The supplying nozzle 72 may be secured to a predetermined position, and designed so as to supply the sealing material paste to a predetermined position. Moreover, upon flattening the sealing material paste supplied to the honeycomb block 100 with the peripheral layer forming head 60, the tip portion of the supplying nozzle 72 may be swung in the longitudinal direction F by a predetermined width in accordance with the rotation of the honeycomb block 100 on the θ-axis. In the latter case, the sealing material paste is supplied in a manner so as to wave on a peripheral face 101, with the longitudinal direction of the honeycomb block 100 serving as the swing direction.

Figure 3A:
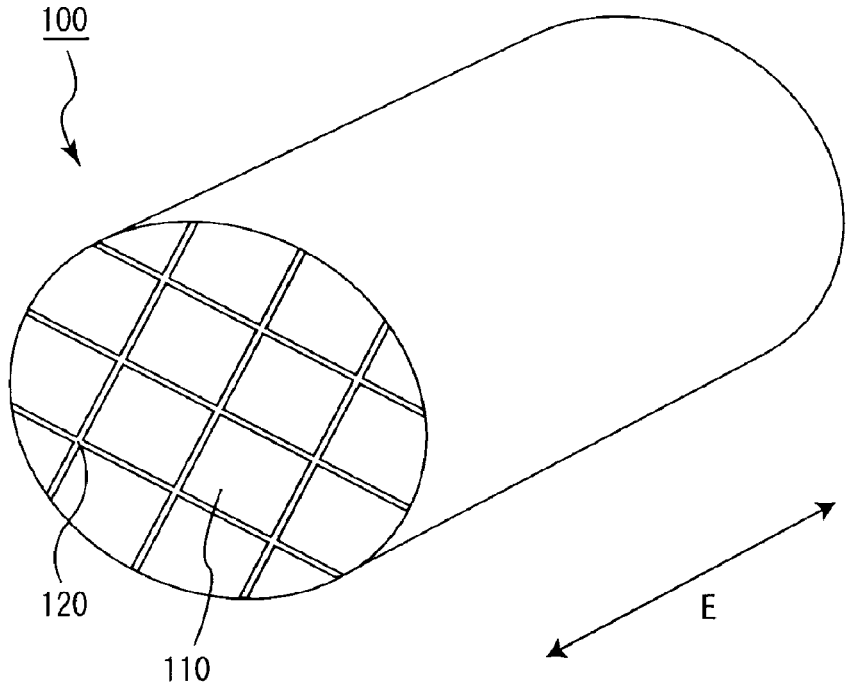
FIG. 3A is a perspective view of one example of a honeycomb block that serves as a member to be coated with a peripheral layer.
Figure 3B:
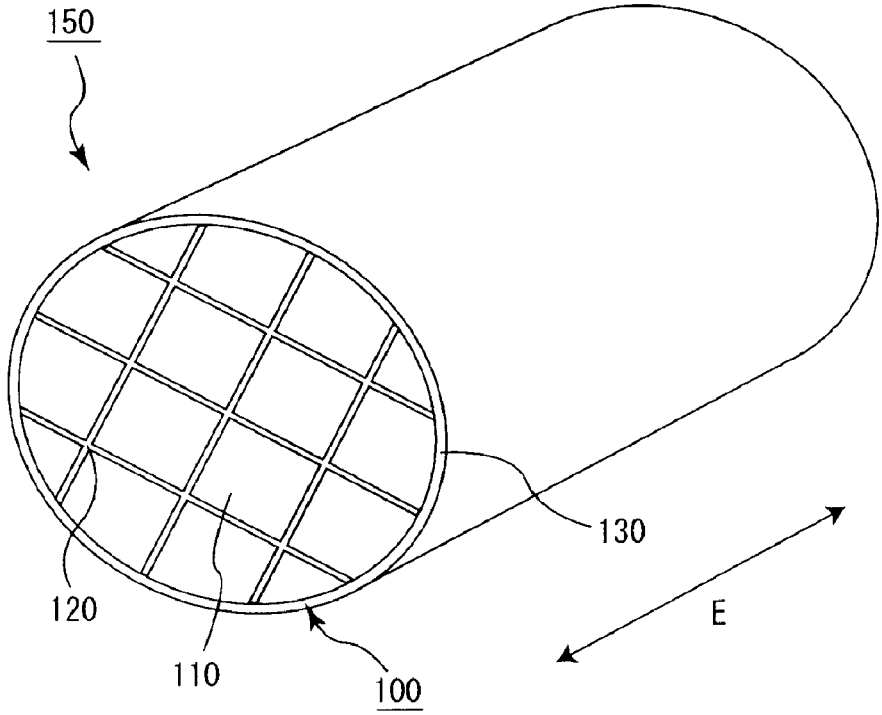
FIG. 3B is a perspective view of one example of a honeycomb structure.
Figure 4A:
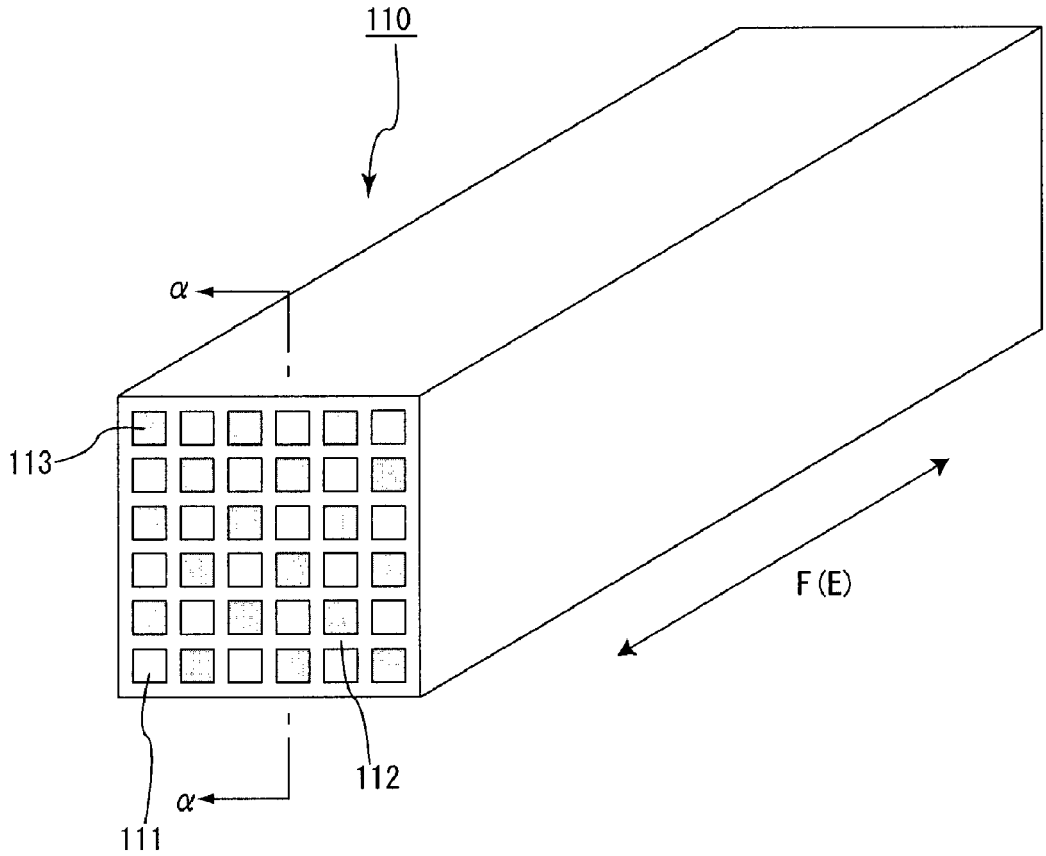
FIG. 4A is a perspective view of a honeycomb fired body configuring a honeycomb structure.
Figure 4B:
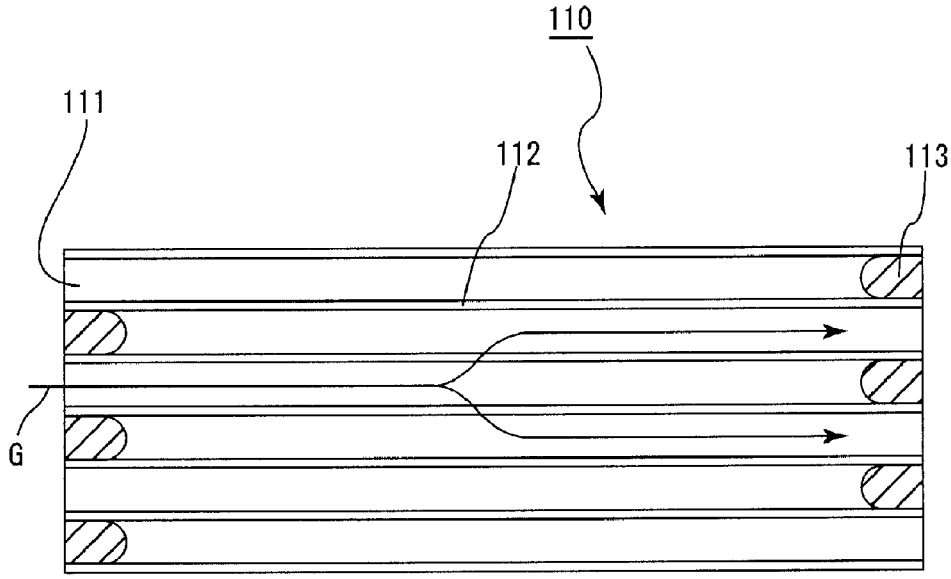
FIG. 4B is a cross-section view of the honeycomb fired body of FIG. 4A taken along a plane extending longitudinally from line $\alpha$-$\alpha$ in FIG. 4A.

Referring to FIGS. 3 and 4, the following description will discuss the honeycomb block 100 that serves as a member to be coated with a peripheral layer. FIG. 3A is a perspective view that schematically shows a honeycomb block 100 prior to the formation of a peripheral layer, and FIG. 3B is a perspective view that schematically shows one example of a honeycomb structure 150 on which the peripheral layer has been formed. Moreover, FIG. 4A is a perspective view that schematically shows a honeycomb fired body 110 configuring the honeycomb structure 150, and FIG. 4B is an α-α line cross-sectional view thereof.

The honeycomb block 100 is formed by cutting the peripheral portion of an aggregated body of honeycomb fired bodies in which a plurality of honeycomb fired bodies 110 are combined with one another by interposing a sealing material layer (adhesive layer) 120 into an elliptical shape in its cross-sectional shape. Moreover, a honeycomb structure 150 is obtained by forming a peripheral layer 130 on the peripheral portion of the honeycomb block 100.

The honeycomb fired body 110 has a structure in which a large number of cells 111 are disposed parallel to one another in the longitudinal direction (the direction shown by an arrow F in FIG. 4A). These cells 111 are separated by cell walls 112. Each of the cells 111, formed in the honeycomb fired body 110, is sealed with a plug 113 at either one of ends on its exhaust gases inlet side and outlet side so that exhaust gases G entered one cell 111 is discharged from another cell 111 after having always passed through a cell wall 112; thus, when the exhaust gases G pass through the cell wall 112, particulates are captured by the cell wall 112 so that the exhaust gases G is purified. Thus, the cell wall 112 is allowed to function as a filter.

The following description will discuss the method for manufacturing a honeycomb structure of the present embodiment in the order of processes.

Here, the following description will describe the method for manufacturing a honeycomb structure in which a silicon carbide powder, that is, a ceramic material, is used as a main component of constituent materials thereof.

First, as a ceramic material, inorganic powders such as silicon carbide powders and the like having different average particle diameters and an organic binder are dry-mixed to prepare a powder mixture, and a liquid-state plasticizer, a lubricant and water are mixed to prepare a liquid mixture, and the powder mixture and the liquid mixture are mixed by using a wet mixing machine so that a wet mixture for manufacturing a molded body is prepared.

The wet mixture thus prepared is transported and charged into a molding apparatus.

When the wet mixture is charged into the extrusion-molding apparatus, the wet mixture is formed into a honeycomb molded body having a predetermined shape through the extrusion-molding. This honeycomb molded body is dried by using a drying apparatus such as a microwave drying apparatus, a hot-air drying apparatus, a dielectric drying apparatus, a reduced-pressure drying apparatus, a vacuum drying apparatus, a frozen drying apparatus and the like so that a dried honeycomb molded body is obtained.

Next, both ends of the honeycomb molded body thus formed are cut by using a cutting apparatus so that the honeycomb molded body is cut into a predetermined length. If necessary, a predetermined amount of plug material paste that forms plugs is filled in ends on the outlet side of a group of cells on the inlet side and ends on the inlet side of a group of cells on the outlet side so that predetermined cells are sealed. Upon sealing the cells, a mask used for sealing the cells is made in contact with the end face (that is, the cut face after the cutting process) of the honeycomb molded body so that only the cells to be sealed are filled with the plug material paste.

The filling of the plug material paste can be carried out if necessary, and upon filling the plug material paste, for example, the resulting honeycomb structure obtained through the post process is suitably used as a honeycomb filter, and in the case where no plug material paste has been filled therein, for example, the honeycomb structure obtained through the post process is suitably used as a catalyst supporting carrier.

Next, in order to degrease the honeycomb molded body with the plug material paste filled therein, the honeycomb molded body is transported to a degreasing furnace by using a degreasing furnace charging apparatus. The honeycomb molded body is charged into a degreasing furnace by a degreasing furnace charging apparatus, and degreased under predetermined conditions (for example, 300 to 500° C.).

Next, the degreased honeycomb molded body is transported to a firing furnace.

Sealing material paste to form a sealing material layer (adhesive layer) is applied to side faces of the honeycomb fired body obtained through the firing process with an even thickness so that a sealing material paste layer is formed, and a piling up process for piling up another honeycomb fired body on this sealing material paste layer is successively repeated so that an aggregated body of honeycomb fired bodies having a predetermined size is manufactured. Here, examples of the sealing material paste include a substance containing an inorganic binder, an organic binder, and at least one of inorganic fibers and inorganic particles, and the like.

Next, this aggregated body of honeycomb fired bodies is heated so that the sealing material paste layer is dried and solidified to form the sealing material layer (adhesive layer). Thereafter, the aggregated body of honeycomb fired bodies in which a plurality of honeycomb fired bodies are combined with one another by interposing the sealing material layer (adhesive layer) is cut by using a diamond cutter and the like so that a cylindroid shaped honeycomb block is manufactured. Through these processes, a honeycomb block 100 prior to the formation of a peripheral layer is prepared.

The following description will discuss operations of a peripheral layer forming apparatus upon forming a peripheral layer on a honeycomb block that is a member to be coated with a peripheral layer. The peripheral layer forming apparatus of the present embodiment has an electrical configuration shown in FIG. 5, and the respective constituents are operated based on electrical signals that are inputted and outputted in the directions shown by arrows in FIG. 5.

An electronic control unit (hereinafter, referred to as ECU) 81 is configured by a microcomputer including a CPU, a ROM, a RAM and the like, not shown, and peripheral circuits thereof. The ECU 81 has a processing unit 81*a*. This processing unit 81*a* executes arithmetic processing in accordance with predetermined programs based on values from a position sensor 82, and outputs control signals to the θ-axis servo 27, y-axis servo 44, x-axis servo 54, the paste supplying device 70 and the like.

The position sensor 82 detects the positional relationship between the periphery 101 of the honeycomb block 100 and the peripheral layer forming head 60 (that is, squeegee 61). As the position sensor 82, for example, a so-called reflection-type sensor, which radiates a laser, an electromagnetic wave, an ultrasonic wave, or the like to a member to be measured (at least one of a supporting member, a peripheral layer forming head and a honeycomb block), and receives a reflected wave so as to measure a coordinate position, may be used.

The position sensor 82 may be an inner scale sensor integrally assembled in the supporting members 21 and 22 and the peripheral layer forming head 61. Moreover, the number of steps of the servos 27, 44 and 54 may be computed by the processing unit 81*a* so that the position may be detected.

Figure 5:
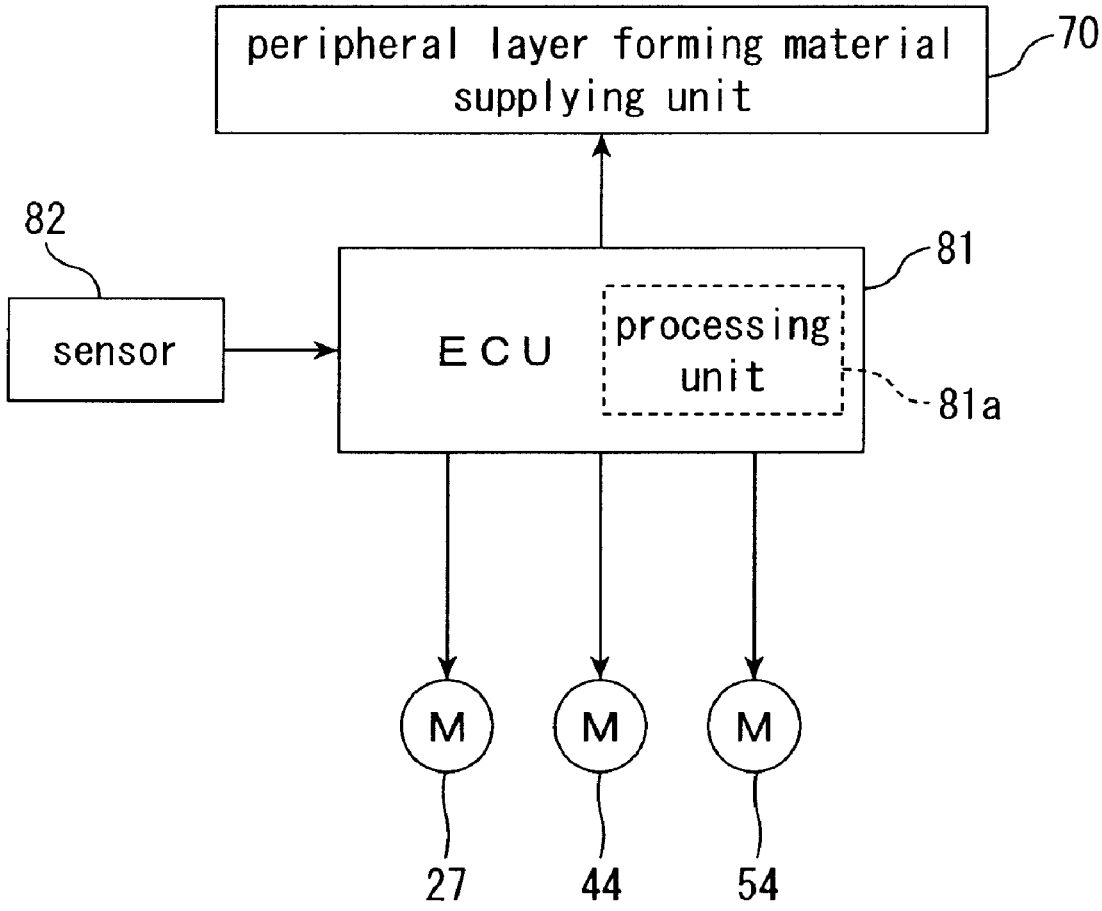
FIG. 5 is a block diagram that shows electrical connections of the peripheral layer forming apparatus of the first embodiment.

Here, FIG. 5 is a block diagram in which the position sensor 82 is independently disposed.

Moreover, the ECU 81 outputs electrical signals to control the servos 27, 44 and 54, that is, to execute the rotation control of the servo step motors and the control of the material supplying operation of the paste supplying device 70.

Figure 6:
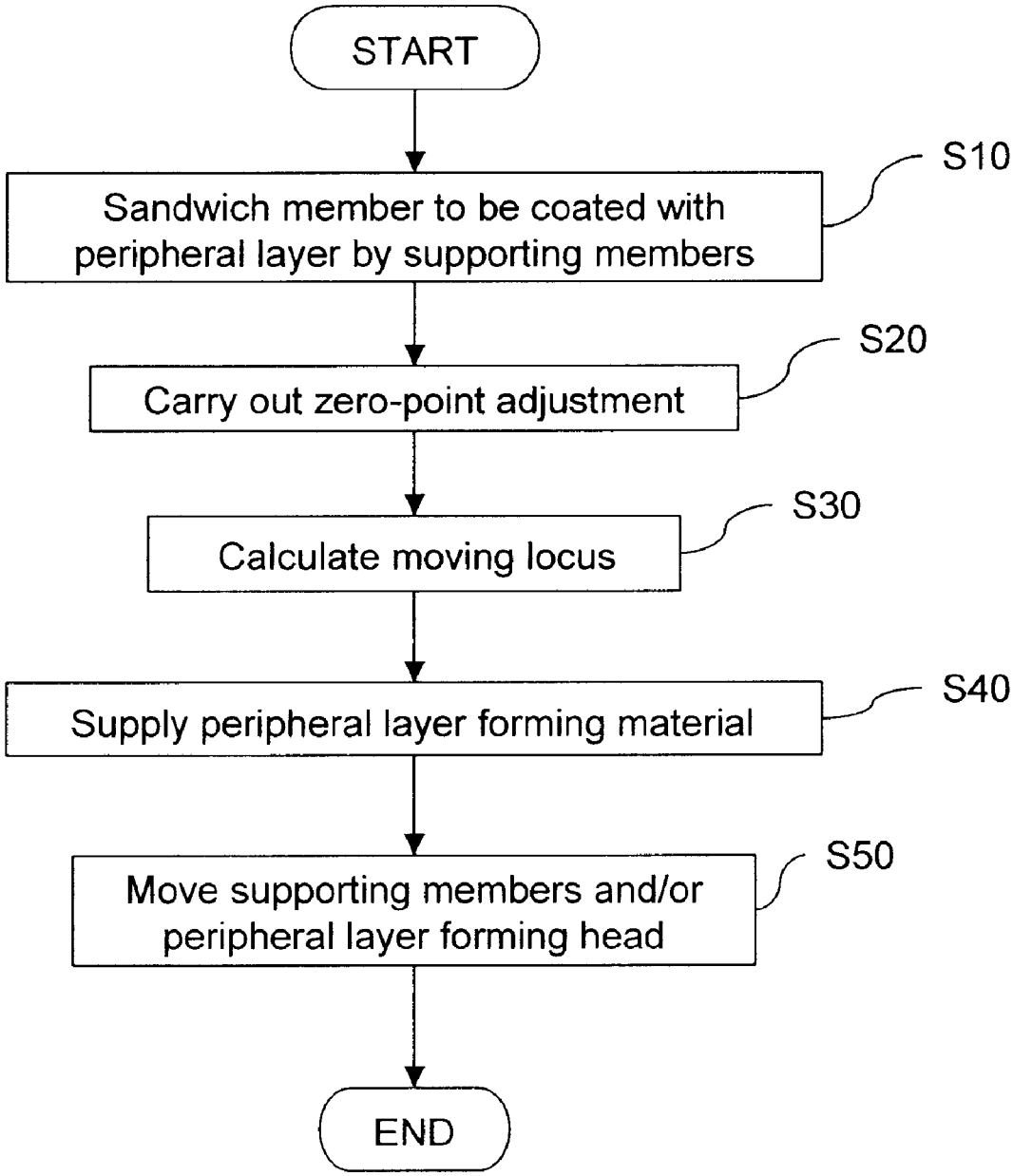
FIG. 6 is a flowchart of operations of the peripheral layer forming apparatus according to an embodiment of the present invention.

The peripheral layer forming apparatus of the present embodiment is operated in accordance with a flowchart shown in FIG. 6. When the operator, for example, turns the start switch on, the peripheral layer forming apparatus 10 of the present invention starts its operations.

In S10, the operator allows a honeycomb block 100 to be supported between the right and left supporting members 21 and 22. More specifically, the honeycomb block 100 is located at a predetermined position to the supporting members 21 and 22 by using a jig and the like, and the supporting member 22 is moved by using the air cylinder 36.

In S20, zero-point adjustment is carried out so that the positions of the peripheral face 101 of the honeycomb block 100 and the tip of the squeegee 61 are set at predetermined positions. Thus, factors such as the steps of the servos 27, 44 and 54 and the detected value of the position sensor 82, are determined at initial values.

As the method for carrying out the zero-point adjustment, for example, the following method may be used in which the honeycomb block 100 supported by the supporting members 21 and 22 and the peripheral layer forming head 60 serving as a reference face are slightly made in contact with each other so that the respective positions are fixed, and in this state, the zero-point adjustment is carried out by pressing the reset button. Moreover, in a butted state, a position at which no step changes are present among the x-axis servo, y-axis servo and θ-axis servo may be determined as the zero-point. As described above, in the case where the squeegee 61 is used as the reference face, the squeegee 61 including an iron plate and the like that is hardly deformed may be used.

Additionally, in the present embodiment, the zero-point adjustment may be carried out continuously (one by one on the honeycomb blocks on which the peripheral layer is formed), or intermittently (for example, on every 10 honeycomb blocks).

In S30, based on the shape of the honeycomb block 100 after the formation of the peripheral layer, the processing unit 81*a* computes an ideal (theoretical) locus of the peripheral layer forming head 70. The computing process of the locus may be carried out on each honeycomb block 100 based on the zero-point, or may be carried out by using preliminarily given data.

In S40, the processing unit 81*a* computes the supply amount of the peripheral layer forming material based on data of the ideal locus for movement computed in S30 and the like. In accordance with the calculated data of the supply amount, the ECU 81 sends a control signal to the paste supplying device 70 so that the peripheral layer forming material is supplied onto the peripheral face 101 of the honeycomb block 100.

In S50, before or after the peripheral layer forming material has been supplied to the vicinal face of the squeegee 61, or simultaneously with the supply, the movement of the honeycomb block 100 in the axis radial direction of the axis and the rotational motion of the honeycomb block 100 in the rotational direction corresponding to the axis circumferential direction are started based on the locus for movement.

Based on the ideal locus data computed in S30, the ECU 81 sends signals to the θ-axis servo 27, y-axis servo 44 and x-axis servo 54. Thus, the relative positions of the honeycomb block 100 to the peripheral face 101 are controlled so that the peripheral layer 130 is formed.

With this arrangement, the sealing material paste, supplied from the paste supplying device 70 to the vicinal face of the squeegee 61, is flattened over the entire peripheral face 101 of the honeycomb block 100 to form a peripheral layer with a predetermined thickness.

The above-mentioned processes are carried out n times, that is, the number of honeycomb structures (n pcs) based on the production plan.

Figure 8:
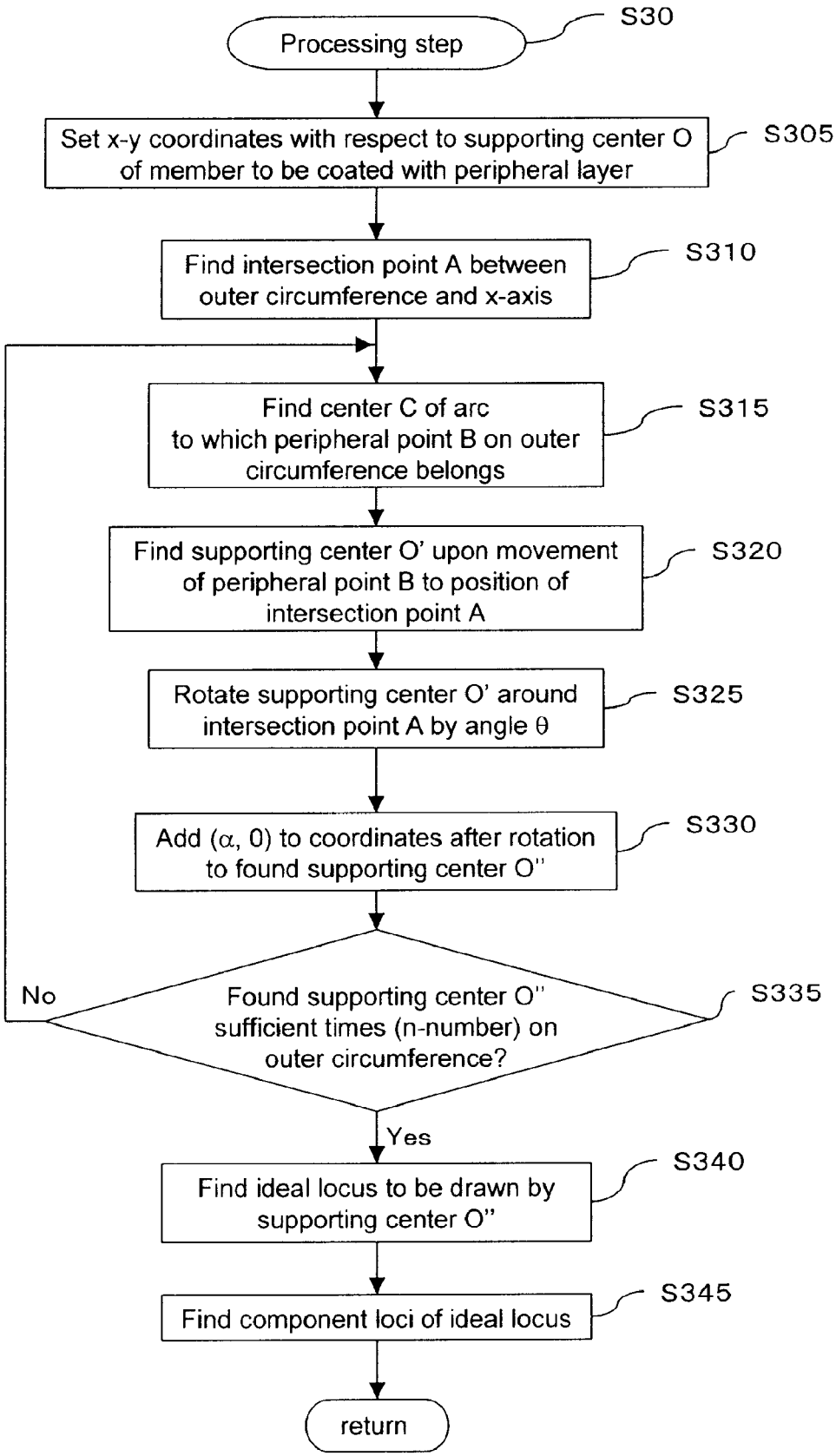
FIG. 8 is a flowchart of processing steps used to calculate an ideal locus.

Referring to FIGS. 7, 8 and 9, the following description will discuss a method for forming the peripheral layer in detail. FIG. 7 is a schematic view that shows a relationship between the peripheral face 101 of the honeycomb block 100 and the squeegee 61.

A face B possessed by the squeegee 61 is extended in the axis direction, and contains a line L parallel to a direction (the direction shown by an arrow E in FIG. 3) that is present on the peripheral face 101 of the honeycomb block 100. Moreover, the face B has a predetermined angle α to a virtual face A (hereinafter, referred to simply as "virtual face") that is in contact with the peripheral face 101. Also, the length in an axis direction E of the face B, that is, the length of the squeegee 61, is almost the same as that of the honeycomb block 100 in the axis direction E.

Since the predetermined angle α formed by the virtual face A and the face B is maintained at any position as long as it is on the peripheral face 101 of the honeycomb block 100, the squeegee 61 having the face B is also allowed to have a predetermined relationship with the virtual face A on the peripheral face 101 of the honeycomb block 100. Here, the distance between the peripheral face 101 of the honeycomb block 100 and the squeegee 61 may be determined in accordance with the thickness of the peripheral layer 130 to be formed on the peripheral face.

In the present specification, the contact faces of the honeycomb block 100 with the supporting members 21 and 22 are also referred to as end faces, and the other faces are also referred to as side faces.

As described above, in the peripheral layer forming apparatus 10 of the present invention, the face B of the squeegee and the virtual face A on the peripheral face 101 of the honeycomb block 100 have such a relationship that a predetermined angle α is formed. In order to control the respective motion of the x-axis servo 54, the y-axis servo 44 and the θ-axis servo 27 so as to maintain this angle α, the honeycomb block 100 is made to move as shown by a two-dot chain line in FIG. 2. At this time, the center axis O of the honeycomb block 100 is rotated in such a manner that the position thereof viewed from the z-axis in FIG. 2 is allowed to swing.

By the rotation of the honeycomb block 100 in this manner, the virtual face A on the peripheral face 101 and the face B of the squeegee 61 are allowed to have a fixed angle α (see FIG. 7) between the virtual face A and the face B (see FIG. 7), even if the honeycomb block 100 is located at any point of the locus.

The following description will discuss controlling processes by which the squeegee 61 is moved relative to the peripheral face 101 so as to allow the face B of the squeegee 61 and the virtual face A to maintain the predetermined angle α.

On the cross section of the honeycomb block 100 cut in a direction perpendicular to the axis direction, the outer circumference of the cross section (hereinafter, referred to simply as "outer circumference") is dealt as an outer circumference formed by combining arc portions of circles, each having a predetermined radius, and the honeycomb block 100 is rotated by the θ-axis servo 27 within a range corresponding to the center angle for the arc length so that the center of the circle to which each arc belongs is made coincident with the rotational center of the rotation centered on the axis direction of the honeycomb block 100. Based on this principle, the shape of the honeycomb block serving as the member to be coated with a peripheral layer is not limited to the cylindroid shape, and this principle can be applied to a honeycomb block having any desired shape. In the principle, however, since the center of the circle to which each arc belongs is not necessarily made coincident with the center of the face that supports the honeycomb block 100 (rotational center of the supporting member, hereinafter, referred to also as "supporting center"), the non-coincidence can be corrected by carrying out the following procedures.

The following procedures 1) to 11) can be used to correct the non-coincidence. In this case, the procedure relates to the honeycomb block having the cylindroid shape; however, this principle may be revised if necessary and applied even to another shape.

First, the following description will discuss a processing step to be carried out in the ECU 81 (S30). FIG. 8 is a flowchart that shows the processing step (S30), and FIGS. 9A to 9C are schematic views that show a principle used for forming a peripheral layer on the member to be coated with a peripheral layer.

The processing step (S30) is activated, for example, when a sensor detects that the honeycomb block 100 has been supported by the supporting members 21 and 22 and the detection signal is outputted to the ECU 81.

Figures 9A, 9B, 9C:
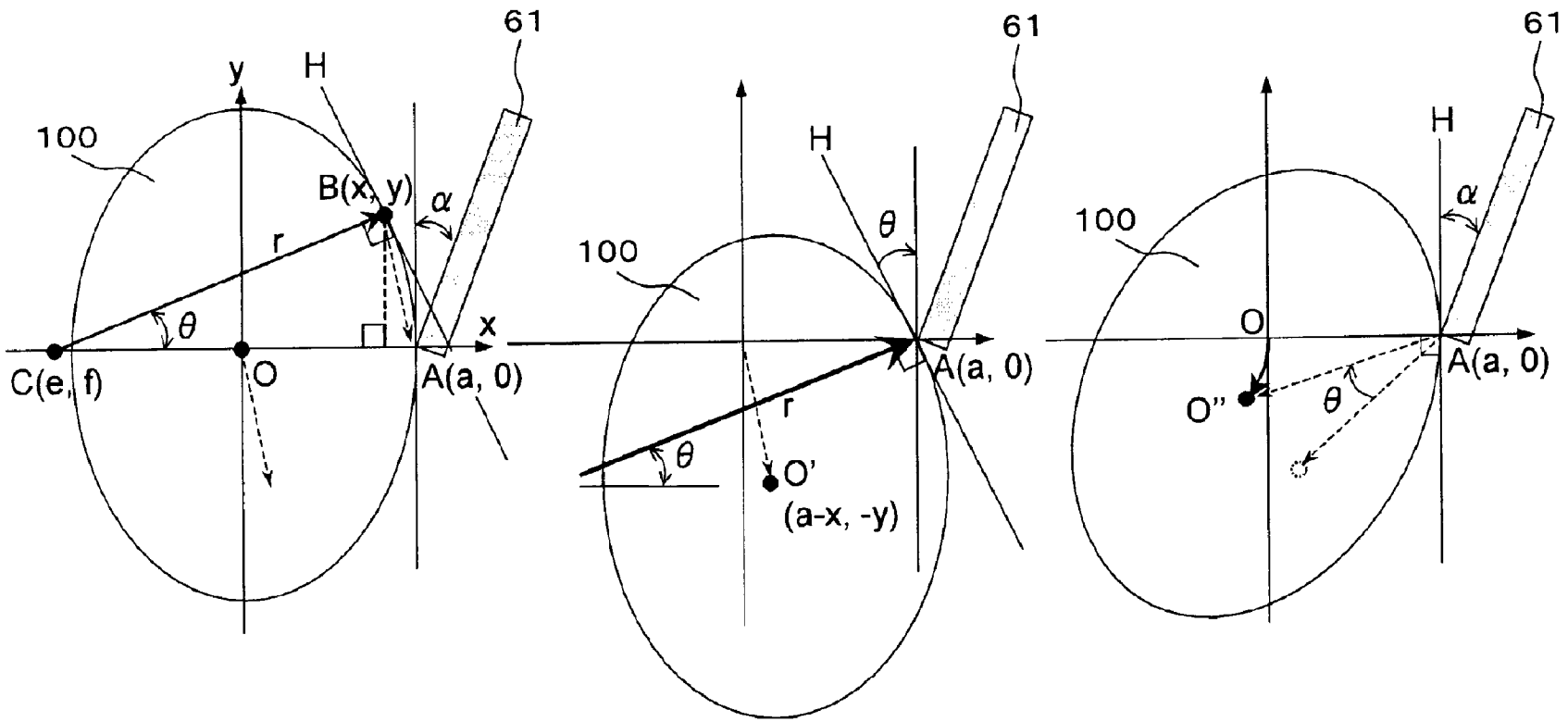
FIGS. 9A to 9C are schematic views that show a principle used for forming a peripheral layer on a member to be coated with the peripheral layer.

1) As shown in FIG. 9A, x-y coordinates are set so as to make the supporting center O of the honeycomb block 100 coincident with the origin, with the minor axis and the major axis of the outer circumference of the elliptical shape being coincident with the x-axis and y-axis respectively (step S305).

2) At a point in which the x-axis crosses the outer circumference, the squeegee 61 is made in contact with the outer circumference with a predetermined angle, and the coordinates of its intersection point A is set as (a, 0) (see FIG. 9A) (step S310). A tangent on the outer circumference at the intersection point A at this time is made parallel to the y-axis, and the angle between the tangent at the intersection point A and the squeegee 61 is a predetermined angle α.

3) An optional point (hereinafter, referred to as "circumferential point B") on the outer circumference is taken at coordinates (x, y), a tangent H is drawn at this circumferential point B, and the center C of an arc to which the circumferential point B belongs is found so that the coordinates of the center C of the arc are set as (e, f) (step S315). At this time, supposing that the angle between the x-axis and the line segment BC is θ, the following equation (i) is satisfied $$\theta=\arctan((y-f)/(x-e)) \tag{i}$$

4) The circumferential point B (coordinates (x, y)) is translated to the position of the intersection point A (coordinates (a, 0)). Accordingly, the tangent H at the circumferential point B is allowed to pass through the intersection point A, and the supporting center O is also translated from coordinates (0, 0) to (a−x, −y) (see FIG. 9B) (step S320).

5) Moreover, the supporting center O' after the translation (coordinates (a−x, −y)) is rotated by the angle θ centered on the intersection point A (a, 0) so that the tangent H at the circumferential point B (that is coincident with the intersection point A in FIG. 9B) is made parallel to the y-axis (see FIGS. 9B and 9C) (step S325). The determinant of the rotation of the supporting center O' centered on the intersection point A is represented by the following equation (ii).

$$\begin{pmatrix} \cos\theta & \sin\theta \\ -\sin\theta & \cos\theta \end{pmatrix}\begin{pmatrix} -x \\ -y \end{pmatrix} = (-x\cos\theta - y\sin\theta,\ x\sin\theta - y\cos\theta) \tag{ii}$$

$$\left(\text{In the equation, } \theta = \arctan\left(\frac{y-f}{x-e}\right)\right)$$

Here, in the equation (ii), the matrix transformation for rotation centered on the intersection point A as the origin has been made; therefore, as shown in the following equation (iii), by adding (a, 0) to the coordinates thus obtained and then translating the resulting coordinates, the coordinates of a supporting center O" after the rotation in the coordinate system centered on the origin O can be obtained (step S330).

$$O''(-x\cos\theta - y\sin\theta + a,\ x\sin\theta - y\cos\theta) \tag{iii}$$

$$\left(\text{In the equation, } \theta = \arctan\left(\frac{y-f}{x-e}\right)\right)$$

6) By translating the coordinates in this manner, a locus, which is drawn by the movement from the supporting center O of the honeycomb block 100 to the supporting center O"

thereof, is obtained (shown by a solid-line arrow in FIG. 9C). Moreover, as the relationship between the virtual face on the peripheral face and the face of the squeegee 61 after the rotation, the tangent H at the circumferential point B shown in FIG. 9C (superposed on intersection point A) is made to have a predetermined angle α with the squeegee 61. In other words, since the supporting center is allowed to draw the locus, the face of the squeegee 61 can be moved from the intersection point A to the circumferential point B along the peripheral face while maintaining the predetermined angle α relative to the virtual face on the peripheral face.

Here, the description has been given by using an enlarged rotational angle θ for convenience of description; however, actually, by setting the rotational angle θ to a fine angle, the matrix transformation of rotation is carried out at a large number of points over the entire periphery of the peripheral face of the honeycomb block 100 (step S335) so that an ideal locus drawn by the supporting center of the honeycomb block 100 is found (step S340).

Here, at step S335, with respect to the setting of the number of points (n-number) of the supporting centers O" after the rotation to be found over the entire periphery of the peripheral face of the honeycomb block 100, the setting may be made based on optional criteria in accordance with the shape of the honeycomb block (the member to be coated with a peripheral layer) 100.

By the above-mentioned steps, the ideal locus through which the honeycomb block 100 serving as the member to be coated with a peripheral layer is allowed to move so as to maintain a predetermined angle is preliminarily found.

7) Based on the ideal locus thus obtained, the coordinates of the supporting center forming the ideal locus is decomposed into an x-axis component, a y-axis component and a θ-axis component (corresponding to the rotational angle θ), and a component locus for each of the components is found in accordance with the lapse of time (step S345).

Figure 10:
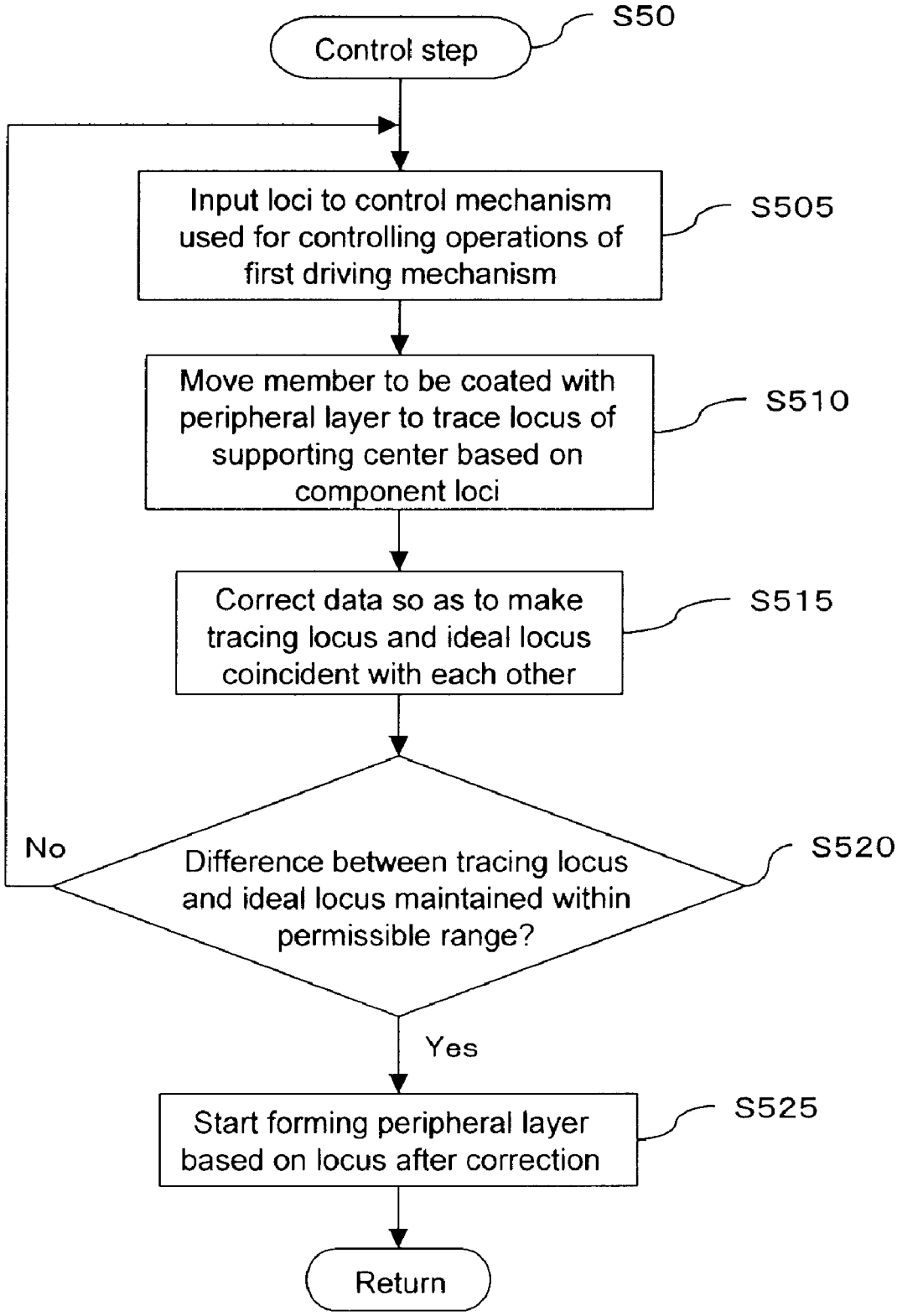
FIG. 10 is a flowchart of control steps.

Next, referring to FIG. 10, the following description will discuss controlling processes (S50).

8) Component loci found in step S345 are inputted to a control mechanism (not shown) that controls respective operations of the x-axis servo, y-axis servo and θ-axis servo (step S505).

9) The honeycomb block 100 is supported by the supporting members, and based on the inputted component loci, the x-axis servo, y-axis servo and θ-axis servo are actually operated, and simultaneously the locus of the supporting center is traced while the position data of the supporting center and the rotational angle data at this time is monitored by a position sensor (step S510).

By the above-mentioned steps, the loci are traced when the honeycomb block 100 is moved so as to maintain a predetermined angle, so that the actually traced loci can be obtained.

10) A difference between the traced locus and the ideal locus found by calculations is found so that the position data and the rotational angle data are corrected so as to make the traced locus promptly coincident with the ideal locus (step S515).

11) Based on various data corrected in step S515, the steps from step S505 to S515 are repeated predetermined times so that the difference between the traced locus and the ideal locus is made smaller so as to be located within a permissible range (step S520).

By the above-mentioned steps, the traced locus can be corrected so that the difference between the ideal locus and the traced locus becomes as small as possible.

When the difference between the ideal locus and the traced locus is made to be within the permissible range by the correction of the traced locus, component loci relating to the traced locus after the correction (locus for movement) are inputted to the control mechanism, thereby starting to form a peripheral layer by the peripheral layer forming apparatus (step S525). The component loci can be obtained by, for example, decomposing the locus for movement into an x-component, a y-component and a θ-component at given time.

By the above-mentioned steps, the squeegee 61 possessed by the peripheral layer forming head 60 and the peripheral face 101 of the honeycomb block 100 are allowed to move relatively to each other while maintaining the predetermined relationship shown in FIG. 7.

The following description will discuss the functions and effects of the peripheral layer forming apparatus and the method for manufacturing a honeycomb structure to be manufactured by using the peripheral layer forming apparatus of the present embodiment.

(1) Since the supporting members 21 and 22 support a pillar-shaped honeycomb block 100 from the two sides in the axis direction so as to maintain its axis in the horizontal direction, it becomes easy to prevent the peripheral layer 130 from deviating due to gravity and consequently to improve the uniformity of the peripheral layer.

Moreover, since the sealing material paste dropping from the honeycomb block can be reduced, it becomes easy to prevent the dropped sealing material paste from adhering to the rotating shaft and the like of the peripheral layer forming apparatus and consequently to prevent the occurrence of a problem such as failure in the rotation of the rotating shaft.

With this arrangement, since the necessity of frequently cleaning the rotating shaft is eliminated, the number of maintenance can be reduced, making it easy also to reduce the running costs.

(2) Since the paste supplying device 80 for supplying the sealing material paste to the peripheral face of the honeycomb block 100 is disposed, the peripheral layer of the honeycomb structure can be continuously formed. Moreover, since the supplying nozzle 72 is disposed above the honeycomb block 100 in its supported state, the peripheral face 101 is positioned in the dropping direction of the peripheral layer forming material. With this arrangement, the dropping of the peripheral layer forming material may easily be reduced.

(3) In the peripheral layer forming apparatus 10 of the present embodiment, the movement control mechanisms 20, 40 and 50, which can control at least one of the movements among the movement of the supporting members 21 and 22 in the axis direction, the movement thereof in the axis radial direction and the rotational motions thereof in the rotational direction corresponding to the axis circumferential direction, are disposed. With this arrangement, the member to be coated with a peripheral layer can be moved to the squeegee, with the predetermined angle α being maintained; thus, independent of the outer shape of the honeycomb block 100, the peripheral layer 130 may be efficiently formed with a predetermined thickness.

(4) Since the ECU 81 controls operations of the motion control mechanisms 20, 40 and 50, it is possible to form the peripheral layer on the honeycomb block 100 having various kinds of peripheral shapes by using the peripheral layer forming apparatus having the same structure, without the necessity of preparing complex mechanisms and complex processes.

(5) Since the angle between the peripheral face of the honeycomb block 100 and the squeegee is a predetermined constant angle α, it is possible to form a more uniform peripheral layer. Since the uniform peripheral layer is formed, it is possible to prevent exhaust gases from leaking from the honeycomb block after the formation of the peripheral layer (that is, the honeycomb structure), and also to prevent chipping and the like on the cell walls; thus, it becomes easy to provide a good external appearance.

(6) Even in the case where the cross-sectional shape perpendicular to the axis direction of the honeycomb block 100 is an elliptical shape in which a curvature of the peripheral shape is changed, the predetermined angle is allowed to correspond to the curvature so that a peripheral layer having a uniform thickness may easily be formed.

EXAMPLES

The following description will discuss specific examples in accordance with the first embodiment of the present invention, as well as reference examples and a comparative example.

Example 1

Powder mixture was prepared by mixing 250 kg of α-type silicon carbide powder having an average particle diameter of 10 μm, 100 kg of α-type silicon carbide powder having an average particle diameter of 0.5 μm and 30 kg of an organic binder (methyl cellulose).

Next, a liquid mixture was prepared separately by mixing 22 kg of a lubricant (UNILUB, manufactured by NOF Corp.), 5 kg of a plasticizer (glycerin) and 65 kg of water, and this liquid mixture and the powder mixture were mixed by using a wet mixing machine, so that a wet mixture was prepared.

Here, the moisture content of the wet mixture thus prepared was 24% by weight.

Next, this wet mixture was transported to an extrusion-molding machine by using a transporting device and charged into a material charging port of the extrusion-molding machine.

Here, immediately before the charging into the extrusion-molding machine, the moisture content of the wet mixture was 23.5% by weight.

Thus, a molded body having a shape shown in FIG. 4 was manufactured by extrusion-molding.

Next, plug material paste having the same composition as that of the wet mixture was filled in predetermined cells after the raw molded body had been dried by using a microwave drying apparatus and the like.

After having been again dried by using a drying apparatus, a honeycomb fired body comprising a silicon carbide sintered body having a porosity of 40%, an average pore diameter of 11 μm, a size of 34.3 mm×34.3 mm×250 mm, the number of cells (cell density) of 46.5 pcs/$cm^2$ and a thickness of each cell wall of 0.30 mm was manufactured by degreasing the molded body at 400° C., and firing at 2200° C. in a normal-pressure argon atmosphere for 3 hours.

A large number of the honeycomb fired bodies were combined with one another (with sealing material layer (adhesive layer) having a thickness of 1 mm) by using a heat resistant sealing material paste containing 30% by weight of alumina fibers having an average fiber length of 30 μm, 32% by weight of silicon carbide particles having an average particle diameter of 0.6 μm, 25% by weight of silica sol, 5.6% by weight of carboxymethyl cellulose and 28.4% by weight of water, and this was further dried at 130° C. Successively, a honeycomb block 100 having a cylindroid shape with a major axis of 206.4 mm and a minor axis of 99.4 mm on a cross section perpendicular to a longitudinal direction (the direction shown by a double-headed arrow E in FIG. 3A), as shown in FIG. 3A was manufactured by cutting an aggregated body of the dried honeycomb fired bodies with a diamond cutter.

Next, a sealing material paste was prepared by mixing and kneading 23.3% by weight of silica-alumina fibers (average fiber length: 100 μm, average fiber diameter: 10 μm) as inorganic fibers, 30.2% by weight of silicon carbide powder having an average particle diameter of 0.3 μm as inorganic particles, 7% by weight of silica sol ($SiO_2$ content in sol: 30% by weight) as an inorganic binder, 0.5% by weight of carboxymethyl cellulose as an organic binder and 39% by weight of water.

Next, using the peripheral layer forming apparatus 10 of the first embodiment, a peripheral layer 130 was formed on the peripheral face of the honeycomb block 100 by the sealing material paste. The specifications of the peripheral layer forming apparatus 10 and a procedure for forming the peripheral layer are shown below.

A honeycomb block 100 was sandwiched by the supporting members 21 and 22 each having a supporting face with a urethane layer formed thereon, with a pressing force of 200 kg. Next, the angle α between the face of the squeegee 61 of the peripheral layer forming head 60 and the virtual face on the peripheral face was set to 60° (see FIG. 7) so that the peripheral face and the squeegee 61 made of rubber were adjusted to be just in contact with each other. Thereafter, the honeycomb block 100 was moved through operations of the x-axis servo, y-axis servo and θ-axis servo while maintaining the angle α so that the relative speed between the honeycomb block 100 and the squeegee 61 was almost 7 m/min. During these processes, 200 g of the sealing material paste was supplied from the peripheral layer forming material supplying unit 70. Thus, a peripheral layer 130 having a thickness of 0.3 mm was formed on the peripheral face of the honeycomb block 100.

Moreover, a honeycomb structure 150 having a cylindroid shape with a major axis of 207 mm and a minor axis of 100 mm in its cross section and a length of 254 mm, on which the peripheral layer 130 was formed on the peripheral face by drying the sealing material paste, was manufactured by drying the sealing material paste at 130° C.

Example 2

A honeycomb structure was manufactured in the same manner as in Example 1, except that the predetermined angle α was each of the values shown in Table 1.

TABLE 1

| | Example 1 | Example 2 | Example 3 | Example 4 | Reference Example 1 | Reference Example 2 | Reference Example 3 | Reference Example 4 | Comparative Example 1 |
|---|---|---|---|---|---|---|---|---|---|
| Angle α | 30° | 60° | 60° | 60° | 0° | 90° | 60° | 60° | Not constant |
| Diagonal cut-out portion | Absent | Absent | Present | Present | Absent | Absent | Present | Present | Absent |
| Angle β | — | — | 4° | 8° | — | — | 0° | 12° | — |
| Appearance | Satis- | Satis- | Satis- | Satis- | Nonuniform | Thin, with | Nonuniform | Thin | Chipping on |

TABLE 1-continued

| | | Example 1 | Example 2 | Example 3 | Example 4 | Reference Example 1 | Reference Example 2 | Reference Example 3 | Reference Example 4 | Comparative Example 1 |
|---|---|---|---|---|---|---|---|---|---|---|
| | | factory | factory | factory | factory | in thickness, with slight irregularities | slight irregularities | in thickness, with slight irregularities | | peripheral layer, with irregularities |
| Surface roughness (Rmax) (μm) | | 86 | 85 | 89 | 85 | 105 | 101 | 103 | 92 | 110 |
| Exhaust gas leakage test (adhesion of soot) | | Hardly any adhesion | Hardly any adhesion | Hardly any adhesion | Hardly any adhesion | Slight partial adhesion | Slight partial adhesion | Slight partial adhesion | Hardly any adhesion | Adhesion over wide range |
| Thickness of peripheral layer (mm) | 1 | 0.23 | 0.18 | 0.24 | 0.21 | 0.27 | 0.11 | 0.38 | 0.20 | 0.49 |
| | 2 | 0.41 | 0.22 | 0.28 | 0.26 | 0.15 | 0.15 | 0.21 | 0.15 | 0.22 |
| | 3 | 0.19 | 0.34 | 0.27 | 0.25 | 0.45 | 0.14 | 0.12 | 0.27 | 0.55 |
| | 4 | 0.25 | 0.39 | 0.30 | 0.31 | 0.32 | 0.22 | 0.37 | 0.11 | 0.35 |
| | 5 | 0.22 | 0.20 | 0.32 | 0.26 | 0.12 | 0.17 | 0.21 | 0.23 | 0.19 |
| | Average | 0.26 | 0.27 | 0.28 | 0.26 | 0.26 | 0.16 | 0.26 | 0.19 | 0.36 |
| | Standard deviation | 0.09 | 0.09 | 0.03 | 0.04 | 0.13 | 0.04 | 0.11 | 0.06 | 0.16 |

Examples 3 and 4

Figure 14:
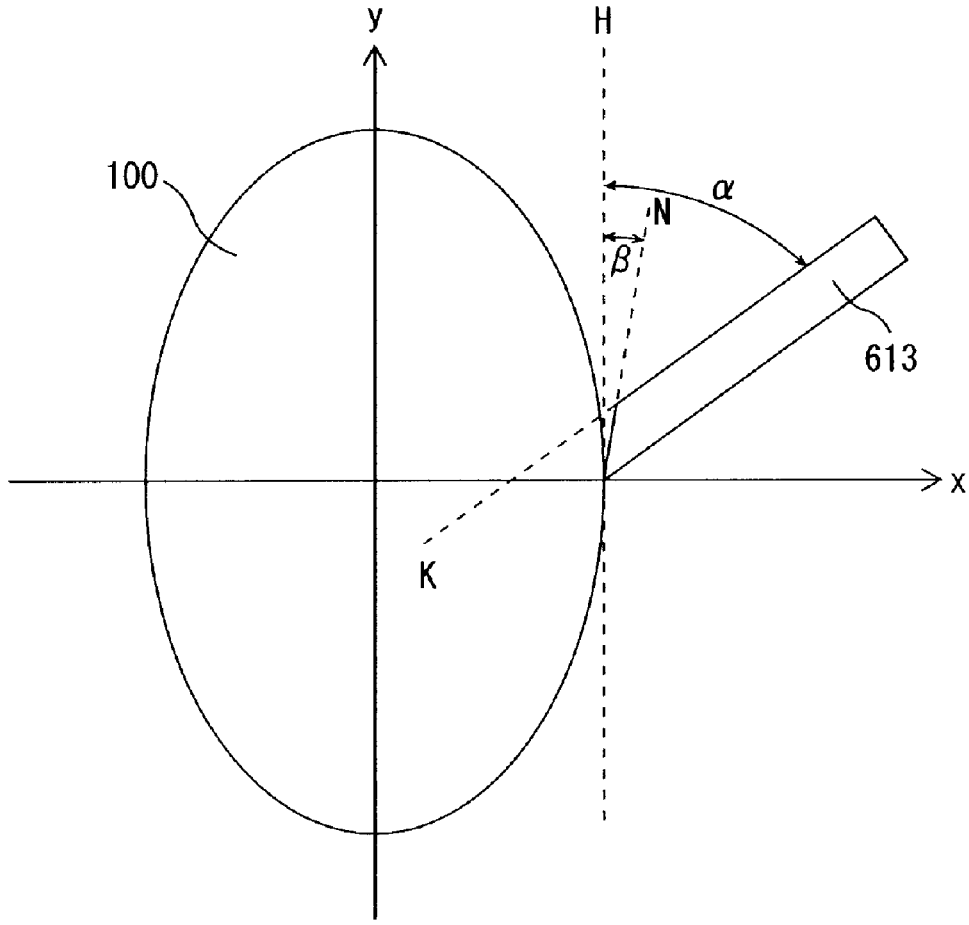
FIG. 14 is a schematic view of yet another example of a cross-sectional shape of the squeegee.

A honeycomb structure was manufactured in the same manner as in Example 1, except that the predetermined angle α was set to each of the values shown in Table 1 and that by forming the tip portion (vicinal portion to the honeycomb block) of the squeegee into a diagonally cut out shape as shown in FIG. 14, the cut-out angle was set to β.

Reference Examples 1 to 4

A honeycomb structure was manufactured in the same manner as in Example 1, except that the predetermined angle α, the presence or absence of the cut-out processing on the tip portion of the squeegee and the cut-out angle β were set as shown in Table 1.

Comparative Example 1

A honeycomb structure was manufactured in the same manner as in Example 1, except that a peripheral layer was formed without maintaining the angle between the peripheral face of the honeycomb block and the squeegee at a constant angle.

As the method for forming the peripheral layer without maintaining the angle at a constant angle, the following procedure was adopted, in which the peripheral layer was formed by operating only the x-axis servo and the θ-axis servo and not operating the y-axis servo upon moving the honeycomb block while controlling its motion. More specifically, the end faces of a honeycomb block were supported by the supporting members 21 and 22 so as to allow the major axis of its cross section to be horizontal, and the peripheral layer forming head 60 was disposed so that the initial angle between the virtual face on the peripheral face and the face of the squeegee was 60°. Next, the rotation by using the θ-axis servo and the movement in the x-axis direction by using the x-axis servo were carried out so that the shortest distance between the peripheral face and the squeegee 61 was maintained constant. In a schematic view of the cross section shown in FIG. 9, the origin O was allowed to move only in the x-axis direction, not to move in the y-axis direction. In this procedure, although the shortest distance was maintained constant, the angle between the peripheral face and the squeegee was not constant.

As for each of the honeycomb structures manufactured in Examples 1 to 4, Reference Examples 1 to 4 and Comparative Example 1, evaluation was made on the following items.

(Visual Evaluation on Outside Appearance)

Adhesion of the sealing material paste to the shaft supporting each of the supporting members and the outside appearance of each of the manufactured honeycomb structures were visually observed.

(Measurements on Surface Roughness)

Based on JIS B 0601-1982, the surface roughness (Rmax) was measured by scanning the portion having the smallest curvature of the side face of each of the honeycomb structures in a circumferential direction with a contact probe profilometer (manufactured by TOKYO SEIMITSU Co., LTD.), in the following conditions: a trace speed of 0.3 mm/s; a cut-off of 2.5 mm; a reference length of 2.5 mm; and a longitudinal magnification of 500 times.

The contents of JIS B 0601-1982 are incorporated herein by reference in their entirety.

(Exhaust Gas Leakage Test)

Figure 11:
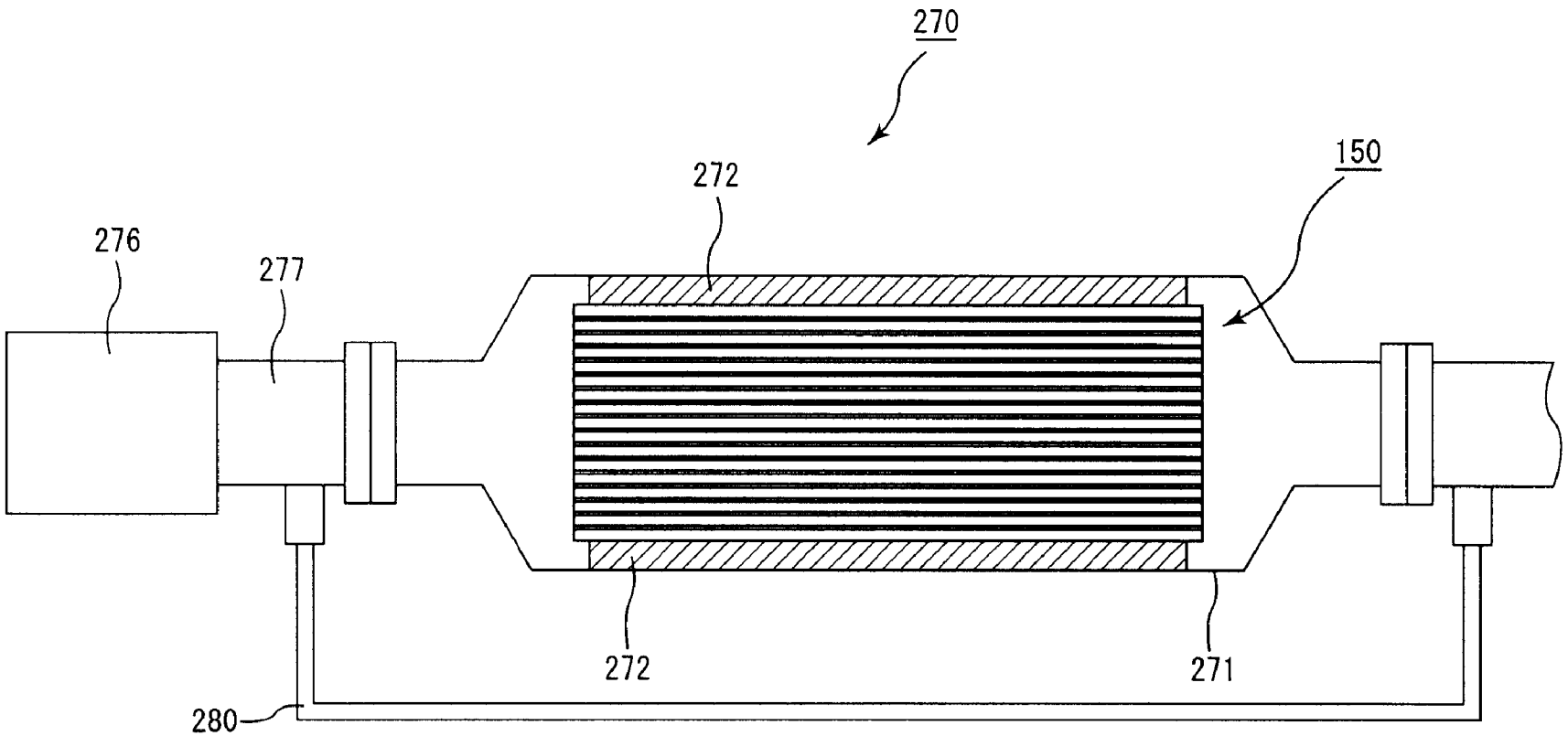
FIG. 11 is an explanatory view of an exhaust gas leakage testing apparatus.

An exhaust gas leakage test was carried out on each of the manufactured honeycomb structures by using an exhaust gas leakage test device 270 as shown in FIG. 11. FIG. 11 shows an explanatory view of the exhaust gas leakage test apparatus.

This exhaust gas leakage test apparatus 270 is configured by a 2 L common-rail diesel engine 276, an exhaust gas pipe 277 that allows exhaust gases from the engine 276 to pass, a metal casing 271 that is connected to the exhaust gas pipe 277 to form one portion of the exhaust gas pipe 277, and a pipe 280 that discharges excessive exhaust gases. The metal casing 271 is placed with a distance of 100 cm from the engine 276, and a honeycomb structure 150, wrapped with a mat 272 including ceramic fibers with a thickness of 8.5 mm, is secured to the metal casing 271. Here, each of the honeycomb structures manufactured in the examples, the reference examples and the comparative example was used as the honeycomb structure 150.

The exhaust gas leakage test was carried out while the engine 276 was driven at the number of revolutions of 3000 $min^{-1}$ and a torque of 50 Nm for 30 minutes, and exhaust gases from the engine 276 were allowed to flow through the honeycomb structure 150; thus, the gas leakage was examined by confirming whether or not soot adhered to the mat 272 due to leakage of exhaust gases from the peripheral layer.

(Measurements on the Thickness of the Peripheral Layer)

As for the peripheral layer of the manufactured honeycomb structure, the peripheral layer was divided into five equal portions at optional positions, and the thickness of each peripheral layer was measured by using a factory microscope TMM (manufactured by TOPCON Corp.) at the equally divided five positions.

The results of the respective evaluations are shown in Table 1

In Examples 1 to 4 and Reference Examples 1 to 4, no adhesion of the sealing material paste to the rotating shaft and the like was found, and the peripheral layer was formed on the peripheral face of the honeycomb block without causing any problem and the like in the rotational motion during the procedure for forming the peripheral layer.

As clearly shown in Table 1, in Examples 1 to 4, the product was satisfactory without any irregularities on the appearance, the surface roughness was small, and it was found from the result of the exhaust gas leakage test that hardly any soot adhered to the mat 272. Moreover, no deviations were observed in the thickness of the peripheral layer 130 so that the layer was formed with a uniform thickness. In Reference Examples 1 to 4, slight irregularities were found on the appearance, and the surface roughness became slightly higher than that of Examples, and in the exhaust gas leakage test, soot adhered slightly on one portion of the mat 272, with slight deviations in the thickness of the peripheral layer. However, these were not so serious and caused no problems in the practical use as the product; thus, generally good results were obtained.

In contrast, in Comparative Example 1, although no problem was caused in the rotational motion of the supporting members, a chipping occurred in the peripheral layer of the honeycomb structure, and presumably, because of the chipping, the exhaust gas leakage test showed that soot adhered to the mat 272 in a wide range. Moreover, the surface roughness was high, with large deviations found in the thickness of the peripheral layer, failing to obtain good results.

It follows that by forming the peripheral layer in a manner so as to maintain a predetermined angle $\alpha$ between the virtual face on the peripheral face and the face of the squeegee, it is possible to form a peripheral layer having a uniform thickness. Moreover, although not particularly limited, in the case where the value of the angle $\alpha$ is about 30 to about 60°, the peripheral layer can be easily formed more uniformly without any deviations.

In other words, by forming a peripheral layer on the peripheral face of a honeycomb block by the use of the peripheral layer forming apparatus of the first embodiment, it becomes possible to efficiently manufacture a honeycomb structure having a peripheral layer that has a uniform thickness and a reduced exhaust gas leakage, without causing any problems and the like in the rotational motions of the supporting members (functions and effects (5)).

Moreover, in the functions and effects (7), in the case where the value of the angle $\alpha$ is about 30 to about 60°, it becomes possible to form a peripheral layer that is more uniform and less vulnerable to deviations.

Second Embodiment

Figure 12:
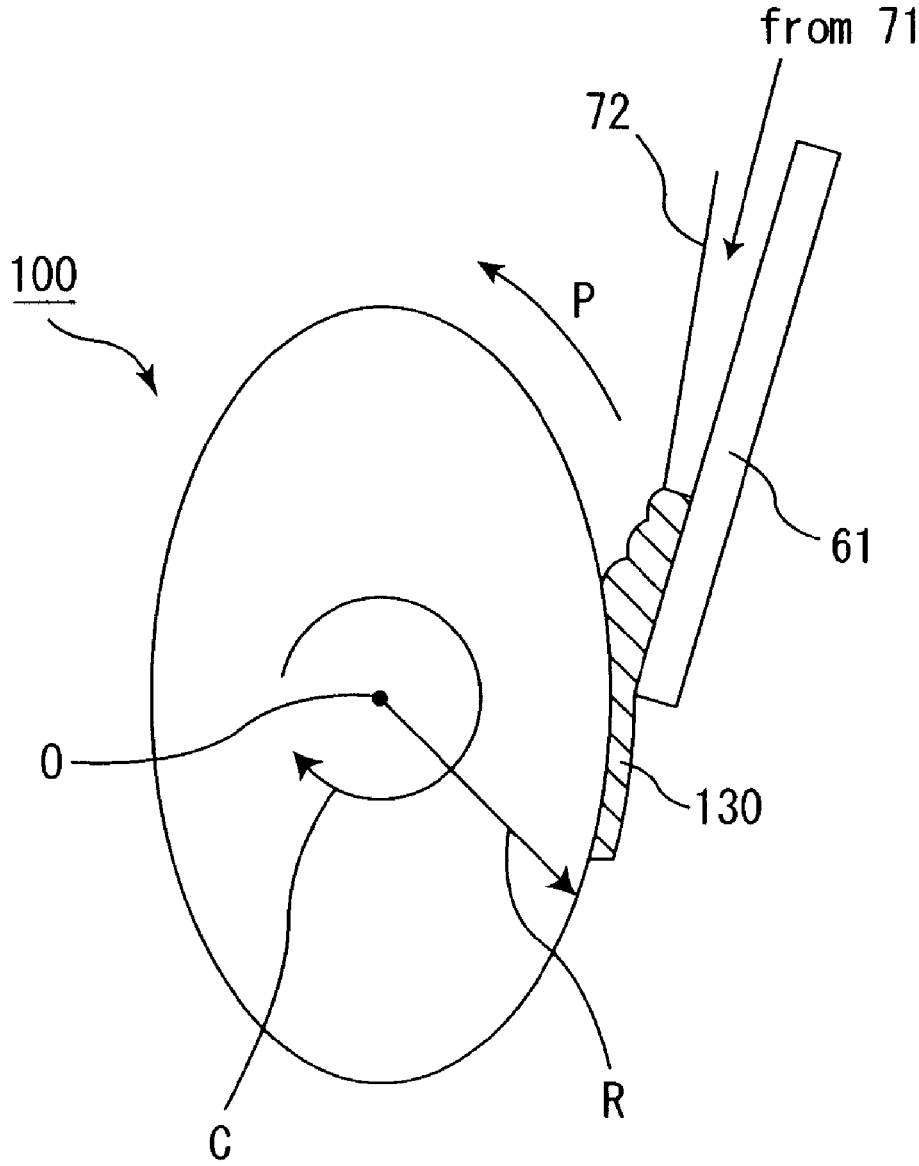
FIG. 12 is a cross-sectional view that shows a second embodiment of the present invention.

The peripheral layer forming apparatus of the present embodiment shown in FIG. 12 has a structure in which the supplying nozzle 72 of the paste supplying device 70 used for supplying a sealing material paste to the peripheral face of the honeycomb block 100 is integrally disposed with the peripheral layer forming head 70, and is also disposed in an advancing direction P of the squeegee 61.

The shape of the supplying port of the sealing material paste at the tip of the supplying nozzle 72 is not particularly limited, and may be a round shape, a square shape, a rectangular shape, an elliptical shape, an elongated rectangular shape, or a combined shape of these, or another desired shape. Moreover, a single supplying port may be formed on the tip of a single supplying nozzle 72, or a plurality of supplying ports may be formed.

Here, as a mode in which the paste supplying device 70 and the peripheral layer forming head 60 are integrally formed with each other, for example, a mode in which the supplying nozzle 72 is not extended to the vicinal face of the squeegee 61, but allowed to supply the sealing material paste to the peripheral face 101 through a slit formed so as to reach the vicinal face of the squeegee 61 may be used.

In the case where the paste supplying device 70 is disposed inside of the peripheral layer forming head 60, the peripheral layer can be formed on the peripheral face of the honeycomb block 100 almost simultaneously with the supply of the sealing material paste to the peripheral face.

This embodiment also achieves the functions and effects (1) to (6) of the first embodiment, and since this embodiment allows the peripheral layer forming head and the paste supplying device to be disposed in the closest state, the effect of preventing the material from dropping is exerted more efficiently.

Moreover, the other function and effect can be obtained that an accidental contact between the peripheral layer forming head 60 and the paste supplying device 70, which might occur in the case where these are separately disposed, is prevented.

In particular, immediately after the start of the formation of the peripheral layer, the peripheral face 101 on which the peripheral layer 130 has not been formed and the squeegee 61 tend to be in contact with each other to cause damage to the squeegee 61. However, in the present embodiment, since the material supplied by the supplying nozzle 72 onto the peripheral face 101 is immediately made in contact with the squeegee 61, it is possible to solve the problem.

Third Embodiment

In addition to the first embodiment, the present embodiment also provides a procedure for controlling the peripheral velocity on the peripheral face. In this case, the angular velocity of the rotational motion by the $\theta$-axis servo can be controlled in the following manner to control the peripheral velocity on the peripheral face. In a simple method, assuming that an ideal angular velocity, which is a constant value, is $\omega$, and on the outer circumference regarded as an aggregate of arcs, the ideal angular velocity $\omega$ is divided by the value of the radius of the circle to which each arc area belongs, for each of the arc areas. With this step, even in the case where the radius of the circle to which an arc area belongs varies for each of the arc areas forming the outer circumference, since the angular velocity $\omega$ is divided by the radius of the circle, the peripheral velocity in the circumference (that is, the periphery) of the circle becomes constant.

This peripheral layer forming apparatus achieves the functions and effects (1) to (6), and also controls the peripheral velocity on the peripheral face 101 of the honeycomb block 100. Consequently, even in the case where a change in the curvature and the like occurs on the peripheral shape of the honeycomb block 100, a stress that is exerted between the peripheral face 101 of the honeycomb block 100 and the peripheral layer forming head 60 may easily be maintained at a constant value. Therefore, the peripheral layer may easily be formed on the peripheral face with a constant thickness.

Fourth Embodiment

The first embodiment has exemplified a configuration in which the support and rotation mechanism 20, the lifting and lowering control mechanism 40 and the forward and backward motion control mechanism 50 are allowed to move the honeycomb block 100, so that the relative position between the peripheral layer forming head and the peripheral face 101 of the honeycomb block 100 is controlled.

In the present embodiment, in place of the support and rotation mechanism 20, the lifting and lowering control mechanism 40 and the forward and backward motion control mechanism 50, a second driving mechanism (θ-axis servo, x-axis servo, y-axis servo, not shown), which can control the movement of the peripheral layer forming head 60, that is, at least one of the movement in the axis direction O, the movement in the axis radial direction R of the axis O and the rotational motion in the rotational direction corresponding to the axis circumferential direction C of the axis O, is disposed.

With this arrangement also, the peripheral layer 130 can be formed on the honeycomb block 100 through the same operations as in the first embodiment.

Therefore, this embodiment of course achieves the functions and effects (1) to (6) described in the first embodiment.

Here, in the case where the second driving mechanism is additionally disposed to the first embodiment, the movement of the honeycomb block 100 and the peripheral layer forming head 60 in the axis radial direction R of the axes O and the rotational motion of the honeycomb block 100 and the peripheral layer forming head 60 in the rotational direction corresponding to the axis circumferential direction C of the axis O can be controlled. With this arrangement, it becomes easy to form a uniform peripheral layer 130 on the peripheral face 101 of the honeycomb block 100 having a peripheral shape having a large curvature.

Fifth Embodiment

The peripheral layer forming apparatus of the first embodiment is provided with the x-axis servo and the y-axis servo as driving mechanisms used for moving in the axis radial direction of the axis, and by further including a z-axis servo that can control movement in the z-axis direction, movement in the axis direction E (movement in the z-axis direction in FIG. 1) can be controlled as well.

With this arrangement, the operations of the supporting members 21 and 22 used for supporting the honeycomb block 100 can be automatically carried out without the manual operations of the operator.

Moreover, this arrangement makes it possible to form a peripheral layer even on a honeycomb block having an outside shape in which the cross-sectional area perpendicular to the axis direction varies as moving in the axis direction, for example, a honeycomb block having a barrel shape. Here, the present embodiment also achieves the functions and effects (1) to (6) of the first embodiment.

Sixth Embodiment

The first embodiment has exemplified a configuration in which the zero-point adjustment is carried out; however, the zero-point adjustment can be omitted as long as the supporting members 21 and 22 accurately support the honeycomb block 100 at predetermined positions. As the method for accurately supporting the honeycomb block 100 at the predetermined positions of the supporting members 21 and 22, fixing jigs may be used.

The fixing jigs are not particularly limited, and for example, fixing jigs made of urethane, which have recessed portions having the same shape as of the end face of the honeycomb block, may be used. Upon using the fixing jigs of this kind, for example, these are attached to the peripheral portions of the supporting members so that the contact faces of the recessed portions of the supporting members 21 and 22 with the end faces of the honeycomb block 100 are formed into almost the same faces.

With this arrangement, this embodiment also achieves the functions and effects (1) to (6) of the first embodiment, and makes it possible to reduce complication relating to the zero-point adjustment.

Seventh Embodiment

In the case where a peripheral layer is formed on the peripheral face of a honeycomb block by using the peripheral layer forming apparatus of the first embodiment, it is possible to form the peripheral layer with a uniform thickness without deviations. Therefore, in a honeycomb structure having such a peripheral layer, cracks and the like hardly occur in the peripheral layer thus formed, and it can achieve a superior appearance and makes it easy to effectively prevent leakage of exhaust gases upon being used as a product.

After the peripheral layer has been formed on the peripheral face of the honeycomb block, if necessary, a catalyst is supported on the honeycomb blocks with the peripheral layers formed thereon, that is, on a honeycomb structure. The supporting of the catalyst may be carried out on honeycomb fired bodies prior to forming an aggregated body.

Upon supporting the catalyst, desirably, an alumina film (layer) having a large specific surface area is formed on the surface of a honeycomb structure, and a co-catalyst and a catalyst such as platinum are applied to this alumina film.

With this arrangement, it is possible to decompose and remove toxic gas components and particulates contained in exhaust gases.

Eighth Embodiment

The honeycomb block 100 that has been described in the first embodiment is an aggregated honeycomb structure configured by a plurality of honeycomb fired bodies that are combined with one another by interposing a sealing material layer (adhesive layer); however, the honeycomb block may be an integral honeycomb structure comprising a single honeycomb fired body.

Upon manufacturing such an integral honeycomb structure, first, a honeycomb molded body is manufactured by using the same method as the method for manufacturing an aggregated honeycomb structure, except that the size of a honeycomb molded body molded through an extrusion-molding process is greater than that in the case of manufacturing the aggregated honeycomb structure.

Next, in the same manner as in the method for manufacturing the aggregated honeycomb structure, the honeycomb molded body is dried by using a microwave drying apparatus, a hot-air drying apparatus, a dielectric drying apparatus, a reduced-pressure drying apparatus, a vacuum drying apparatus, a freeze drying apparatus and the like.

Then, a cutting process is carried out on the ends of the dried honeycomb molded body.

Next, a predetermined amount of plug material paste to form plugs is filled in end portions on the outlet side of cells on the inlet side as well as in end portions on the inlet side of cells on the outlet side to seal the cells.

Thereafter, in the same manner as in the manufacture of the aggregated honeycomb structure, the resulting honeycomb molded body is degreased and fired, so that a honeycomb block comprising a single honeycomb fired body is manufactured. Next, by forming a peripheral layer on the peripheral face of the honeycomb block by use of the peripheral layer forming apparatus of the first embodiment, an integral honeycomb structure with the peripheral layer formed thereon is manufactured.

As the main constituent material for the integral honeycomb structure, cordierite and aluminum titanate may be used.

Here, a catalyst may also be supported on the integral honeycomb structure.

The present embodiment of course achieves the functions and effects (1) to (6) described in the first embodiment.

Ninth Embodiment

As the honeycomb block of the first embodiment, a honeycomb block used for a honeycomb filter for collecting particulates in exhaust gases has been mainly described; however, in the case where no sealing process is carried out on the honeycomb fired body, the resulting honeycomb block may be suitably used as a catalyst supporting carrier (honeycomb catalyst) for converting exhaust gases.

The present embodiment of course achieves the functions and effects (1) to (7) in the first embodiment.

Other Embodiments

The method for manufacturing the honeycomb block 100 of the first embodiment may be modified in the following manner.

That is, the area of the supporting face of the supporting member is desirably made smaller than the area of the contact face of the member to be coated with a peripheral layer with the supporting member.

Although the area of the supporting face is larger than the area of the contact face, the peripheral layer may be formed efficiently; however, in the case where the area of the supporting face is made smaller than the area of the contact face, the length of the squeegee in the axis direction may be made longer to such a size as to cover the length of the member to be coated with a peripheral layer (the direction shown by an arrow E in FIG. 7); therefore, this structure is more desirable since it becomes easy to more efficiently form a peripheral layer uniformly.

The length of the squeegee in the axis direction may be desirably made to the same length as the length of the member to be coated with a peripheral layer in the axis direction, or longer than the length thereof.

The length of the squeegee in the axis direction may be the same as the length of the member to be coated with a peripheral layer in the axis direction, or may be made longer or shorter than the length thereof. In the case where the length of the squeegee in the axis direction is shorter than the length of the member to be coated with a peripheral layer in the axis direction, after the squeegee has been moved along the peripheral face, the squeegee is allowed to slide in the axis direction so as to be located at a portion on the peripheral face on which a peripheral layer is newly formed, and the peripheral layer may be formed while it is further moved along the peripheral face. However, in the case where the length of the squeegee in the axis direction is longer than the length of the member to be coated with a peripheral layer in the axis direction, the movement of the squeegee along the periphery of the member to be coated with a peripheral layer make it possible to flatten the peripheral layer forming material over the entire peripheral face by carrying out the movement one or a plurality of times, thereby making it easy to efficiently carry out the operations for forming the peripheral layer, and consequently to form the peripheral layer more uniformly.

On the supporting face of each supporting member, it is desirable to form a buffer layer formed by an elastic material, such as synthetic rubber, natural rubber, silicon resin, urethane resin, epoxy resin and propylene resin.

In the case where the buffer layer is formed on the supporting face of each supporting member, it becomes possible to prevent damages that might be caused upon supporting the member to be coated with a peripheral layer, and since the buffer layer exerts a non-slip function, an appropriate pressure can be applied to support the member to be coated with a peripheral layer.

Figure 13A:
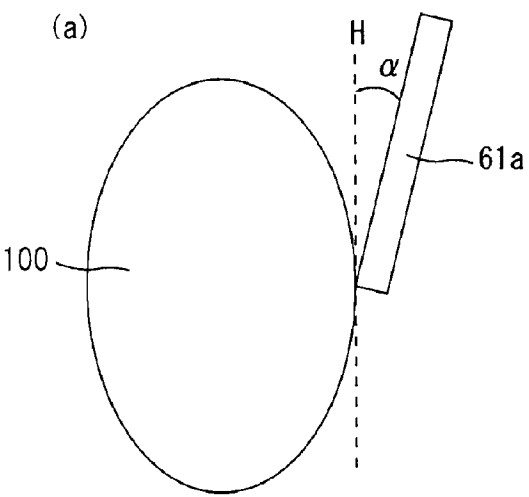
FIG. 13A is a schematic view of one example of a cross-sectional shape of a squeegee.
Figure 13B:
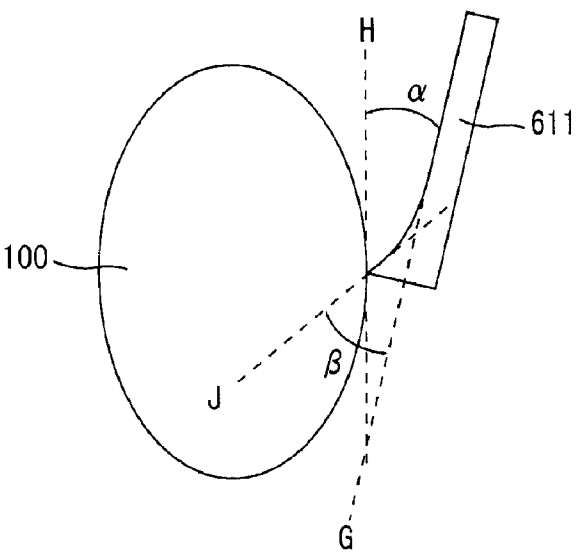
FIG. 13B is a schematic view of another example of a cross-sectional shape of the squeegee.
Figure 13C:
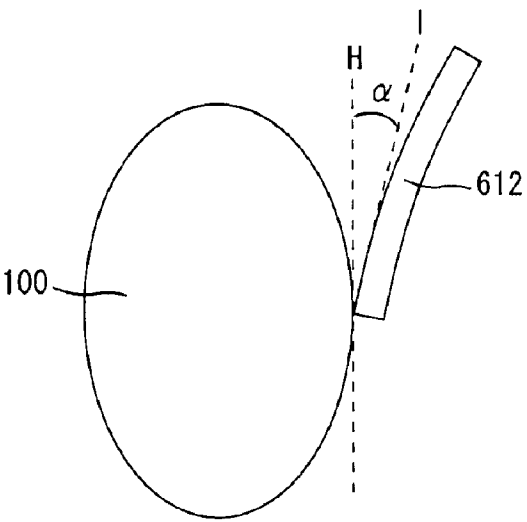
FIG. 13C is a schematic view of still another example of a cross-sectional shape of the squeegee.

FIG. 13A is a schematic view that shows one example of a cross-sectional shape of a squeegee 61 of the first embodiment; FIG. 13B is a schematic view that shows another example of a cross-sectional shape of a squeegee 611; and FIG. 13C is a schematic view that shows still another example of a cross-sectional shape of a squeegee 612. Moreover, FIG. 14 is a schematic view that shows the other example of a cross-sectional shape of a squeegee 613.

As the cross-sectional shape of the squeegee possessed by the peripheral layer forming head 60, a rectangular shape as squeegee 611 shown in FIG. 13A may be used. In this case, the angle formed by a tangent on the cross section perpendicular to the axis direction of the honeycomb block 100 (referred to as tangent H for convenience of description) and the long side of the rectangular shape is a predetermined angle $\alpha$.

Moreover, as the cross-sectional shape of the squeegee, a shape in which the lower side is made longer in comparison with that of the rectangular shape shown in FIG. 13A, with the lower portion of one of the parallel long sides being curved downward, as shown in FIG. 13B, may be used. In the case where the squeegee 611 has a shape as shown in FIG. 13B, since the squeegee 611 is allowed to hold a sufficient amount of the peripheral layer forming material to form the peripheral layer at the curved area, it becomes easy to smoothly form the peripheral layer on the peripheral face of the honeycomb block 100. In this case, the angle between the long side in the case of the shape assumed to be the rectangular shape and the tangent L is a predetermined angle $\alpha$.

In addition to the shape described above, the cross-sectional shape of the squeegee may be a trapezoidal shape having a wide width with one end of the rectangular shape being cut off, as shown in FIG. 14. In this case, the angle formed by the tangent H and a broken line N passing through the intersection point between the tangent H and the x-axis is $\beta$. Although not particularly limited, the size of the angle $\beta$ is desirably about 2 to about 10°. In the case where the angle $\beta$ is about 2° or more, the peripheral layer forming material that has escaped from the most vicinal point between the honeycomb block 100 and the squeegee 613 is easily separated from the squeegee, preventing an irregular thickness in the resulting peripheral layer. In contrast, in the case where the angle $\beta$ is about 10° or less, the cut-off face at the tip does not tend to become too wide, preventing an increase in friction between the squeegee 613 and the peripheral layer forming material; consequently, it becomes easy for the peripheral layer forming material to move toward the peripheral portion of the honeycomb block 100, so that the thickness of the peripheral layer does not tend to become thin.

The squeegee desirably comprises rubber materials such as urethane rubber, silicon rubber, butyl rubber and synthetic rubber, metals such as stainless steel, iron, nickel and nickel/cobalt, plastic materials, and the like may be desirably used, and rubber materials are more desirably used.

In the case where the squeegee comprises rubber, upon forming the peripheral layer, it becomes easy to prevent damages on the peripheral face of the member to be coated with a peripheral layer, and also to form a uniform peripheral layer.

In the case where the squeegee comprises a rubber material as described above, the entire squeegee is curved as shown in FIG. 13C upon forming the peripheral layer. In this case, the angle formed between the tangent H on the periphery of the honeycomb block 100 and a tangent I at an apex where the curved squeegee 612 comes close to the honeycomb block 100 is a predetermined angle α.

The hardness of the squeegee is desirably about 50 to about 90 degrees (hardness specified by JIS K 6031), more desirably, about 60 to about 80 degrees.

In the case where the hardness of the squeegee is about 50 to about 90 degrees, upon forming the peripheral layer, it becomes easy to prevent damages such as chipping on the peripheral face of the member to be coated with a peripheral layer, and also to form a uniform peripheral layer.

The shortest distance between the peripheral face of the member to be coated with a peripheral layer and the squeegee can be altered in accordance with the thickness of the peripheral layer to be formed on the peripheral face, and the lower limit in the case of using the squeegee including rubber is a distance in which the peripheral face and the squeegee are just in contact with each other (that is, 0 mm); in contrast, as the upper limit, it is desirably about 1 mm or less.

In the case where the shortest distance exceeds about 1 mm, a large amount of the peripheral layer forming material is required for forming the peripheral layer to cause a problem from the economic point of view, and also makes it difficult to form a peripheral layer having a uniform thickness.

In the case where at least one of the squeegee and the member to be coated with a peripheral layer is moved, the relative speed between the squeegee and the member to be coated with a peripheral layer may be set by taking working efficiency and the like into consideration, and it is desirably about 1 to about 20 m/min.

In the case where the relative speed is about 1 m/min or more, a process time in forming the peripheral layer may become shorter and reduction in the working efficiency does not tend to be caused; in contrast, in the case where the relative speed is about 20 m/min or less, the resulting peripheral layer does not tend to become thinner.

The pressing force of the supporting members to be applied to support the member to be coated with a peripheral layer is desirably about 100 to about 300 kg, in the case where the weight of the member to be coated with a peripheral layer is about 4 kg.

In the case where the pressing force is about 100 kg or more, the member to be coated with a peripheral layer, which is supported by the supporting members, does not come off while the peripheral layer is being formed. In contrast, in the case where the pressing force is about 300 kg or less, damages such as cracks or chippings on the end faces of the member to be coated with a peripheral layer do note tend to be caused.

The supply amount of the peripheral layer forming material upon supplying the peripheral layer forming material onto the peripheral face of the member to be coated with a peripheral layer, simultaneously forming the peripheral layer, supplied from the peripheral layer forming material supplying unit, is desirably about 50 to about 300 g.

In the case where the supply amount is about 50 g or more, a sufficient amount required for forming the peripheral layer onto the peripheral face of the member to be coated with a peripheral layer may be supplied, preventing a reduction in the working efficiency of forming the peripheral layer. In contrast, in the case where the supply amount is about 300 g or less, the supply amount may not become excessive and subsequently the thickness of the peripheral layer to be formed tends to become sufficiently uniform.

The main component of constituent materials of the honeycomb structure is not limited to silicon carbide, and examples of other ceramic materials include: a nitride ceramic material such as aluminum nitride, silicon nitride, boron nitride and titanium nitride; a carbide ceramic material such as zirconium carbide, titanium carbide, tantalum carbide and tungsten carbide; an oxide ceramic material such as alumina, zirconia, cordierite, mullite and aluminum titanate; and the like.

Among these, a non-oxide ceramic material is desirably used, and in particular, silicon carbide is more desirably used. This material is superior in the heat resistant property, mechanical strength and thermal conductivity. Here, ceramic materials such as silicon-containing ceramic prepared by compounding metal silicon into the ceramic and ceramic which is bonded by silicon or a silicate compound may be used as constituent materials, and among these, a material prepared by compounding metal silicon into silicon carbide (silicon-containing silicon carbide) is desirably used.

The particle diameter of silicon carbide powder in the wet mixture is not particularly limited, and the silicon carbide powder which tends not to cause the case where the size of the honeycomb fired body manufactured by the following firing treatment becomes smaller than that of the degreased honeycomb molded body is desirably used. For example, powder mixture prepared by mixing about 100 parts by weight of powder having an average particle diameter of about 0.3 to about 50 μm and about 5 to about 65 parts by weight of powder having an average particle diameter of about 0.1 to about 1.0 μm, is desirably used.

In order to adjust the pore diameter and the like of the honeycomb fired body, it is necessary to adjust the firing temperature, and the pore diameter can be adjusted by adjusting the particle diameter of the inorganic powder.

The organic binder in the wet mixture is not particularly limited, and examples thereof include carboxymethyl cellulose, hydroxyethyl cellulose, polyethylene glycol, and the like. Among these, methyl cellulose is desirably used. In general, the blending amount of the organic binder is desirably about 1 to about 10 parts by weight to about 100 parts by weight of the inorganic powder.

The plasticizer in the wet mixture is not particularly limited, and for example, glycerin and the like may be used. Moreover, the lubricant is also not particularly limited, and for example, polyoxyalkylene-based compounds such as polyoxyethylene alkyl ether and polyoxypropylene alkyl ether, may be used.

Specific examples of the lubricant include: polyoxyethylene monobutyl ether, polyoxypropylene monobutyl ether, and the like.

Here, the plasticizer and the lubricant are not necessarily contained in the mixed material powder depending on cases.

Upon preparing the wet mixture, a dispersant solution may be used, and the examples thereof include: water, an organic solvent such as benzene, alcohol such as methanol, and the like.

Moreover, a forming auxiliary may be added to the wet mixture.

The forming auxiliary is not particularly limited, and examples thereof include ethylene glycol, dextrin, fatty acid, fatty acid soap, polyalcohol, and the like.

Furthermore, a pore-forming agent, such as balloons that are fine hollow spheres comprising oxide-based ceramics, spherical acrylic particles, graphite, and the like may be added to the wet mixture, if necessary.

The balloons are not particularly limited, and examples include alumina balloons, glass micro balloons, shirasu balloons, fly ash balloons (FA balloons), mullite balloons, and the like. Among these, alumina balloons are more desirably used.

Here, the temperature of the wet mixture containing silicon carbide powder, prepared as described above, is desirably about 28° C. or less. In the case where the temperature is too high, the organic binder tends to be gelatinized.

Moreover, the proportion of organic components in the wet mixture is desirably about 10% by weight or less, and the content of moisture is desirably about 8.0 to about 30.0% by weight.

The plug material paste used for sealing cells are not particularly limited, and those plug material pastes that allow the plugs manufactured through the following processes to have a porosity of about 30 to about 75% are desirably used, and for example, the same material as that of the wet mixture may be used.

Moreover, upon forming an aggregated body of cell-sealed honeycomb molded bodies, cell-sealed honeycomb molded bodies are preliminarily piled up one after another through spacers, and a plug material paste is then filled between the mutual cell-sealed honeycomb fired bodies; thus, an aggregated body of the cell-sealed honeycomb fired bodies may be manufactured.

The examples of the inorganic binder used in the sealing material paste include silica sol, alumina sol, and the like. Each of these may be used alone or two or more kinds of these may be used in combination. Among the inorganic binders, silica sol is desirably used.

The examples of the organic binder used in the sealing material paste include polyvinyl alcohol, methyl cellulose, ethyl cellulose, carboxymethyl cellulose, and the like. Each of these may be used alone or two or more kinds of these may be used in combination. Among the organic binders, carboxymethyl cellulose is desirably used.

The examples of the inorganic fibers used in the sealing material paste include ceramic fibers such as silica-alumina, mullite, alumina, and silica. Each of these may be used alone or two or more kinds of these may be used in combination. Among the inorganic fibers, silica-alumina fibers are desirably used.

The examples of the inorganic particles used in the sealing material paste include carbides, nitrides, and the like, and specific examples include inorganic powder comprising silicon carbide, silicon nitride and boron nitride, and the like. Each of these may be used alone, or two or more kinds of these may be used in combination. Among the inorganic particles, silicon carbide having superior thermal conductivity is desirably used.

Moreover, a pore-forming agent such as balloons that are fine hollow spheres comprising oxide-based ceramics, spherical acrylic particles, graphite, and the like may be added to the sealing material paste, if necessary. The balloons are not particularly limited, and examples thereof include alumina balloons, glass micro balloons, shirasu balloons, fly ash balloons (FA balloons), mullite balloons, and the like may be used. Among these, alumina balloons are desirably used.

Obviously, numerous modifications and variations of the present invention are possible in light of the above teachings. It is therefore to be understood that within the scope of the appended claims, the invention may be practiced otherwise than as specifically described herein.

The invention claimed is:

1. A method for manufacturing a honeycomb structure, said method comprising:

molding a ceramic material to manufacture a pillar-shaped honeycomb molded body having a plurality of cells longitudinally disposed parallel to one another with a cell wall therebetween;

firing said honeycomb molded body to manufacture a honeycomb fired body; and forming a peripheral layer on a peripheral face of a pillar-shaped honeycomb block comprising one or a plurality of said honeycomb fired bodies by use of a peripheral layer forming apparatus, said honeycomb block having an outer circumference of a cross section perpendicular to an axis direction thereof that can be formed by combining arc portions of circles, wherein said peripheral layer forming apparatus comprises:

supporting members;

a peripheral layer forming head having a squeegee with a face;

a material supplying unit that supplies the peripheral layer forming material to the peripheral face at least one of a first driving mechanism being capable of controlling at least one of a movement of the supporting member in the axis direction, a movement of the supporting member in a radial direction of the axis and a rotational motion of the supporting member in a circumferential direction of the axis, the circumferential direction corresponding to a rotational direction, and a second driving mechanism being capable of controlling at least one of a movement of the peripheral layer forming head in the axis direction, a movement of the peripheral layer forming head in the radial direction and a rotational motion of the peripheral layer forming head in the circumferential direction; and an electronic control device that controls at least one of the first driving mechanism and the second driving mechanism by outputting an electrical signal, and wherein the forming of the peripheral layer includes:

allowing the supporting members to sandwich the honeycomb block from both sides of the axis direction of the honeycomb block to support the honeycomb block so that an axis of the honeycomb block is maintained in a horizontal direction;

allowing the material supplying unit to supply a peripheral layer forming material to the peripheral face; and allowing at least one of the squeegee and the honeycomb block to move so as to maintain a predetermined angle between the face of the squeegee and a virtual face, wherein the virtual face is defined as a plane that is parallel to the axis of the honeycomb block and that is tangential to a contact point on a peripheral face of the honeycomb block where the squeegee is configured to contact the honeycomb block; and allowing the electronic control device to find an ideal locus used for moving the squeegee relative to a periphery of the honeycomb block so as to maintain the predetermined angle, said allowing said electronic control device to find an ideal locus including:

setting x-y coordinates so as to make a supporting center of the honeycomb block coincident with the origin;

bringing the squeegee in contact with an outer circumference of the honeycomb block with the predetermined angle at an intersection point in which the x-axis crosses the outer circumference;

taking an optional point on the outer circumference of the honeycomb block;

translating the optional point to the position of the intersection point thereby also translating the supporting center;

rotating the supporting center after the translation so as to make a tangent on the outer circumference at the optional point to have the predetermined angle with the squeegee, with the rotation being centered on the intersection point; and obtaining a locus which is drawn by this movement of the supporting center, allowing the electronic control device to find an actual movement locus of the squeegee upon relatively moving the squeegee; and allowing the electronic control device to control operation of at least one of the first driving mechanism and the second driving mechanism so as to make the ideal locus and the actual movement locus coincident with each other.

2. The method for manufacturing a honeycomb structure according to claim 1, wherein the predetermined angle is about 30 to about 60°.

3. The method for manufacturing a honeycomb structure according to claim 1, wherein a shape of a cross section perpendicular to the axis direction of the honeycomb block is an elliptical shape, a racetrack shape, a substantially triangular shape, a recessed shape, or a substantially polygonal shape.

4. The method for manufacturing a honeycomb structure according to claim 1, wherein the supporting members each have a supporting face of a buffer layer that is formed of an elastic material.

5. The method for manufacturing a honeycomb structure according to claim 1, wherein a cross-sectional shape of the squeegee has a rectangular shape, a rectangular shape with a long curved side on which a peripheral layer forming material is provided, or a trapezoidal shape with a wide width on one end.

6. The method for manufacturing a honeycomb structure according to claim 1, wherein the squeegee comprises at least one of a metal, a rubber, and a plastic.

7. The method for manufacturing a honeycomb structure according to claim 1, further comprising:

sealing one end of each of the cells of the honeycomb structure to provide a honeycomb filter which is capable of capturing particulates by the cell wall; or providing the honeycomb structure as a catalyst supporting carrier without a sealing of the cells.

* * * * *